US010257884B2

(12) United States Patent
Kuwabara

(10) Patent No.: US 10,257,884 B2
(45) Date of Patent: Apr. 9, 2019

(54) SEMICONDUCTOR DEVICE AND HEATING SYSTEM

(75) Inventor: Hideaki Kuwabara, Isehara (JP)

(73) Assignee: SEMICONDUCTOR ENERGY LABORATORY CO., LTD., Kanagawa-ken (JP)

( * ) Notice: Subject to any disclaimer, the term of this patent is extended or adjusted under 35 U.S.C. 154(b) by 2094 days.

(21) Appl. No.: 12/207,112

(22) Filed: Sep. 9, 2008

(65) Prior Publication Data

US 2009/0071952 A1 Mar. 19, 2009

(30) Foreign Application Priority Data

Sep. 13, 2007 (JP) ..... 2007-238464

(51) Int. Cl.
*H05B 1/02* (2006.01)

(52) U.S. Cl.
CPC ..... *H05B 1/0233* (2013.01)

(58) Field of Classification Search
USPC ..... 219/211, 527, 528, 529, 494, 209; 320/108; 257/728
See application file for complete search history.

(56) References Cited

U.S. PATENT DOCUMENTS 3,931,494 A 1/1976 Fisher et al.
4,219,715 A 8/1980 Mandle et al.
4,589,423 A * 5/1986 Turner ..... 607/154
4,801,782 A 1/1989 Ineson
4,949,702 A 8/1990 Suzuki et al.
4,967,061 A 10/1990 Weber et al.
4,980,539 A 12/1990 Walton
4,987,579 A 1/1991 Yoshinaka et al.
5,300,875 A 4/1994 Tuttle
5,521,360 A * 5/1996 Johnson et al. ..... 219/709
(Continued)

FOREIGN PATENT DOCUMENTS

EP 1180806 A 2/2002
EP 1326279 A 7/2003
(Continued)

OTHER PUBLICATIONS

Dembo et al., "RFCPUs on Glass and Plastic Substrates Fabricated by TFT Transfer Technology," IEDM 2005: Technical Digest of International Electron Devices Meeting, Dec. 5, 2005, pp. 1067-1069.

*Primary Examiner* — Ibrahime A Abraham
*Assistant Examiner* — Frederick Calvetti
(74) *Attorney, Agent, or Firm* — Robinson Intellectual Property Law Office; Eric J. Robinson

(57) ABSTRACT

A device that warms a surface of a living body required to be warmed at an appropriate timing at any place indoors and outdoors or the sea without causing low temperature burns. A sheet having a heat generating function including a circuit capable of receiving electric power without contact over a sheet containing plastic or a fibrous body, a heat generating circuit, and a circuit that controls the temperature of the heat generating circuit is manufactured. The user with the sheet transmits the radio signal from the transmission device outdoors or indoors to heat the heat generating circuit on the sheet and the heat can be conducted to the skin of the user. Temperature can be automatically adjusted by the circuit for controlling the temperature of the heat generating circuit.

15 Claims, 17 Drawing Sheets

(56) References Cited

U.S. PATENT DOCUMENTS 5,811,766 A 9/1998 Fabrikant et al.
5,961,871 A * 10/1999 Bible et al. ..... 219/709
5,994,871 A 11/1999 Stove
6,066,164 A * 5/2000 Macher et al. ..... 607/96
6,108,489 A 8/2000 Frohlich et al.
6,469,282 B1 10/2002 Roberts
6,486,452 B2 * 11/2002 Loyd et al. ..... 219/530
6,504,226 B1 1/2003 Bryant
6,559,882 B1 * 5/2003 Kerchner ..... 348/61
6,599,659 B1 7/2003 Endo et al.
6,608,464 B1 * 8/2003 Lew et al. ..... 320/107
6,636,185 B1 * 10/2003 Spitzer et al. ..... 345/8
6,770,848 B2 * 8/2004 Haas et al. ..... 219/212
6,834,969 B2 12/2004 Bade et al.
6,840,955 B2 * 1/2005 Ein ..... 607/108
6,864,140 B2 3/2005 Bryant
6,911,627 B2 6/2005 Oguma et al.
6,924,164 B2 * 8/2005 Jenson ..... 438/48
6,953,919 B2 * 10/2005 Clothier ..... 219/620
7,022,950 B2 * 4/2006 Haas et al. ..... 219/528
7,056,795 B2 6/2006 Bryant
7,121,472 B2 * 10/2006 Shimizu et al. ..... 235/492
7,176,426 B2 2/2007 Ramirez
7,265,324 B2 9/2007 Ozawa et al.
7,443,135 B2 * 10/2008 Cho ..... 320/108
7,494,945 B2 2/2009 Moreshead
7,667,310 B2 * 2/2010 Dozen et al. ..... 257/678
7,710,270 B2 * 5/2010 Shionoiri et al. ..... 340/572.1
7,714,535 B2 5/2010 Yamazaki et al.
7,716,013 B2 * 5/2010 Orth et al. ..... 702/182
7,764,046 B2 7/2010 Osada
7,773,436 B2 8/2010 Inoue et al.
7,830,113 B2 * 11/2010 Sato et al. ..... 320/107
7,965,180 B2 * 6/2011 Koyama ..... 340/539.12
8,074,373 B2 * 12/2011 Macher et al. ..... 36/2.6
8,084,722 B2 * 12/2011 Haas et al. ..... 219/543
8,143,844 B2 * 3/2012 Tamura ..... 320/108
8,170,685 B2 * 5/2012 Docherty et al. ..... 607/100
2002/0153367 A1 10/2002 Haas, Jr. et al.
2002/0175163 A1 * 11/2002 Fagrell ..... 219/709
2003/0032210 A1 2/2003 Takayama et al.
2003/0139142 A1 * 7/2003 Wang ..... 455/67.1
2004/0061176 A1 4/2004 Itoga et al.
2004/0106917 A1 * 6/2004 Ormsby et al. ..... 606/33
2004/0118831 A1 * 6/2004 Martin ..... 219/494
2004/0129450 A1 * 7/2004 Yamazaki et al. ..... 174/250
2004/0166146 A1 * 8/2004 Holloway et al. ..... 424/449
2004/0238527 A1 12/2004 Ozawa et al.
2005/0012627 A1 1/2005 Lion et al.
2005/0017677 A1 * 1/2005 Burton et al. ..... 320/108
2005/0134435 A1 * 6/2005 Koyama et al. ..... 340/10.34
2005/0162131 A1 7/2005 Sennami et al.
2005/0192129 A1 * 9/2005 Kuwabara ..... 473/520
2005/0194926 A1 * 9/2005 Di Stefano ..... 320/108
2005/0254183 A1 * 11/2005 Ishida et al. ..... 361/18
2005/0288777 A1 12/2005 Rhee et al.
2006/0001726 A1 * 1/2006 Kodas et al. ..... 347/105
2006/0060576 A1 * 3/2006 Haas et al. ..... 219/543
2006/0090384 A1 * 5/2006 Woodruff ..... 40/544
2006/0110863 A1 5/2006 Yamamoto et al.
2006/0127593 A1 6/2006 Shinya et al.
2006/0160517 A1 * 7/2006 Yoon ..... 455/299
2006/0197668 A1 * 9/2006 Oliver et al. ..... 340/572.4
2006/0238312 A1 10/2006 Ishii
2006/0270175 A1 11/2006 Aoki et al.
2007/0170170 A1 * 7/2007 Sata et al. ..... 219/497
2007/0171156 A1 7/2007 Kawakami et al.
2007/0176622 A1 * 8/2007 Yamazaki ..... 324/770
2007/0216348 A1 * 9/2007 Shionoiri et al. ..... 320/107
2007/0229228 A1 10/2007 Yamazaki et al.
2007/0229279 A1 * 10/2007 Yamazaki et al. ..... 340/572.7
2007/0229281 A1 * 10/2007 Shionoiri et al. ..... 340/572.7
2007/0262403 A1 11/2007 Tsurume
2007/0278998 A1 * 12/2007 Koyama ..... 320/109
2007/0285246 A1 12/2007 Koyama
2008/0012126 A1 1/2008 Dozen et al.
2008/0055047 A1 * 3/2008 Osada et al. ..... 340/10.1
2008/0055279 A1 3/2008 Osada et al.
2008/0058029 A1 * 3/2008 Sato et al. ..... 455/573
2008/0060422 A1 3/2008 Hosoya
2008/0062066 A1 3/2008 Arai
2008/0076974 A1 3/2008 Yamazaki et al.
2008/0079396 A1 * 4/2008 Yamazaki et al. ..... 320/128
2008/0079565 A1 * 4/2008 Koyama ..... 340/539.12
2008/0094027 A1 4/2008 Cho
2008/0109941 A1 5/2008 Moreshead
2008/0122297 A1 * 5/2008 Arai ..... 307/154
2008/0122401 A1 * 5/2008 Sato et al. ..... 320/107
2008/0136604 A1 6/2008 Kozuma et al.
2008/0149624 A1 6/2008 Tamura
2008/0157606 A1 * 7/2008 Fukutome ..... 307/126
2008/0158217 A1 * 7/2008 Hata et al. ..... 345/211
2008/0174266 A1 7/2008 Tamura
2008/0210762 A1 * 9/2008 Osada et al. ..... 235/492
2008/0211800 A1 9/2008 Arasawa et al.
2008/0214132 A1 * 9/2008 Kurokawa ..... 455/272
2009/0057416 A1 3/2009 Kato
2009/0065588 A1 3/2009 Aoki et al.
2009/0151043 A1 6/2009 Moreshead
2009/0188396 A1 * 7/2009 Hofmann et al. ..... 99/342
2010/0327766 A1 * 12/2010 Recker et al. ..... 315/291
2011/0127248 A1 6/2011 Moreshead
2011/0128686 A1 6/2011 Moreshead
2011/0128726 A1 6/2011 Moreshead
2011/0130813 A1 6/2011 Moreshead
2012/0171788 A1 * 7/2012 Takayama et al. ..... 438/28
2012/0311885 A1 12/2012 Moreshead

FOREIGN PATENT DOCUMENTS

EP 2259324 A 12/2010
JP 57-092779 A 6/1982
JP 63-133027 6/1988
JP 63-133030 6/1988
JP 02-100286 A 4/1990
JP 02-079920 A 6/1990
JP 02079920 * 6/1990
JP 06-147490 5/1994
JP 07-022172 1/1995
JP 07-086113 3/1995
JP 3018843 B 11/1995
JP 30188438 U 11/1995
JP 07-336011 A 12/1995
JP 08-244569 A 9/1996
JP 08244569 * 9/1996
JP 09-112940 A 5/1997
JP 10-127981 5/1998
JP 10-172725 A 6/1998
JP 10-178293 6/1998
JP 10-323363 A 12/1998
JP 11-148652 6/1999
JP 2001-235157 8/2001
JP 2002-063938 A 2/2002
JP 2002-081677 A 3/2002
JP 2002-161410 A 6/2002
JP 2003-033050 1/2003
JP 2003-158394 5/2003
JP 2003-174153 6/2003
JP 2003-243133 A 8/2003
JP 2003243133 * 8/2003
JP 2003-271914 9/2003
JP 2003-298068 A 10/2003
JP 2003-299255 10/2003
JP 2004-134675 4/2004
JP 2004-138331 5/2004
JP 2004-138766 5/2004
JP 2004-355882 12/2004
JP 2005-183272 A 7/2005
JP 2005-242629 9/2005
JP 2005-528281 9/2005
JP 2005-270640 10/2005
JP 2005-273075 A 10/2005
JP 2006-051343 2/2006
JP 2006-086736 A 3/2006

(56) References Cited

FOREIGN PATENT DOCUMENTS

| | | | | |
|---|---|---|---|---|
| JP | 2006-117144 | | | 5/2006 |
| JP | 2006-166522 | | | 6/2006 |
| JP | 2006-170642 | A | | 6/2006 |
| JP | 2006-311415 | A | | 11/2006 |
| JP | 2006311415 | | * | 11/2006 |
| JP | 2006-342449 | | | 12/2006 |
| JP | 2007-149598 | A | | 6/2007 |
| JP | 2007-286999 | | | 11/2007 |
| JP | 2007-312932 | | | 12/2007 |
| JP | 2008-504879 | | | 2/2008 |
| JP | 2008-542063 | | | 11/2008 |
| WO | WO9700493 | | * | 1/1997 |
| WO | WO-2003/103338 | | | 12/2003 |
| WO | WO-2005/111975 | | | 11/2005 |
| WO | WO 2006/009129 | | | 1/2006 |
| WO | WO 2006/101285 | | | 9/2006 |
| WO | WO-2006/127769 | | | 11/2006 |
| WO | WO-2009/089378 | | | 7/2009 |

* cited by examiner

SEMICONDUCTOR DEVICE AND HEATING SYSTEM

BACKGROUND OF THE INVENTION

1. Field of the Invention

This invention relates to a semiconductor device having an integrated circuit including a transistor and a manufacturing method thereof. In specific, this invention relates to a sheet which has an integrated circuit including a transistor as a control circuit and has a heat generating function.

Note that the term "semiconductor device" in this specification refers to a device in general that can operate by utilizing semiconductor characteristics, and an electro-optical device, a semiconductor circuit, and an electronic device are all included in the semiconductor device.

2. Description of the Related Art

Disposable hand warmers have so far been generally used for warmth by being put on a chest, in a pocket, or the like. In recent years, hand warmers that are filled with a gel moisturizing agents and heated by a microwave oven when they are used have been used.

The temperature of such hand warmers cannot be controlled and there is a possibility of causing low temperature burns when the hand warmers are in contact with human skin for a long time. In specific, in the case of warming a person who is physically challenged due to injury, decrepitude, or the like, the hand warmer may be kept in contact with the physically challenged person due to inattention of a care taker and may cause a low temperature burn on the physically challenged person. In addition, in the case of warming a newborn baby or an infant whose thermoregulatory function is insufficient, the hand warmer is avoided because there is also a possibility of causing low temperature burns.

In order to warm a newborn baby or an infant, there is a heating apparatus called a heating pad for warming hands and feet. However, like the hand warmer, there is also a possibility of causing low temperature burns when the heating pad is kept in contact with human skin for a long time. In addition, since heating apparatuses which are in contact with human skin obtain electric power from an outlet through a wiring code, the heating apparatuses cannot be freely placed.

Thus, the body temperature of a physically challenged person, a newborn baby, or an infant is maintained by heating a room by an air conditioner all day. Heating apparatuses that utilize heat conduction by air have disadvantages that they are inefficient and that they cannot heat evenly. In addition, there are problems in that the volume of the heating apparatuses is large and that temperature is hard to be controlled. Further, optimum temperatures differ depending on individuals and it is hard to adjust the temperature so as to satisfy each individual by an air conditioner. Furthermore, since a room is periodically ventilated with air, the air conditioner consumes large amount of electric power. To continuously use the air conditioner is unfavorable in terms of energy saving.

Moreover, in the medical field, when operation with general anesthesia is performed, the body temperature of a patient decreases; therefore, the body temperature is necessary to be increased to prevent an infection when anesthesia wears off after the operation.

Further, after exposure to rain or snow in the mountains or getting out from the water while bathing in the sea, heat is drawn from skin by vaporization of water on the skin. The hand warmer cannot be used for warming wet skin. In addition, in the water, there are no other ways to heat a body except using a wet suit.

As a chip that utilizes wireless communication through radio waves, a wireless tag has been known. A wireless tag that is used for an individual identification technology is called an RFID tag. The RFID tag can be classified into two types based on whether a power source is built-in or supplied from the outside. The RFID tag can be classified into two types, an active RFID tag (active type) with a built-in power source, and a passive RFID tag (passive type) that is driven using electric power of radio waves from the outside, in which radio waves that include information related to an RFID can be transmitted. Of them, the active RFID tag incorporates a power source for driving the RFID tag and includes a battery as the power source. In addition, the passive RFID has a structure in which a power source for driving the RFID tag is generated using electric power of radio waves from the outside, whereby a structure without a battery is realized.

The present inventor discloses sports goods, playing goods, and training goods in which various functional circuits are formed of TFTs over flexible films in Patent Document 1 (Japanese Published Patent Application No. 2005-270640). Patent Document 1 discloses that a temperature sensor is provided to control the temperature by a CPU as well as a piezoelectric elements are provided for soles of running shoes as power generation elements so that feet are heated by heat generation in a TFT circuit by utilizing electric power the piezoelectric elements generate. Further, Patent Document 1 also discloses that a reception circuit is mounted on shoes. Furthermore, Patent Document 1 has a description in which a non-contact electric power transmission module which is capable of charging without contact is mounted on sports goods. Furthermore, Patent Document 1 also discloses that an auxiliary power source for making up for insufficient electric power (a primary battery or a secondary battery), such as a sheet battery is mounted or provided.

Moreover, in Patent Document 2 (Japanese Published Patent Application No. 2006-51343), a technique by which a wireless memory is provided over a flexible film, and the flexible sheet is attached to a head of a human or animal, or part of a human body, so that wireless communication with an external device is performed is disclosed.

Further, in Non-Patent Document 1 (H. Dembo et al. "RFCPUs on Glass and Plastic Substrates Fabricated by TFT Transfer Technology," IEDM Tech. Dig. Papers, pp. 1067 to 1069, 2005), a technique of fabricating a CPU that operates with a radio signal of 13.56 MHz over a plastic substrate is disclosed.

Furthermore, an electronic thermometer in which temperature data showing a temperature is generated by detecting the temperatures of a battery for power source and a part to be measured, the temperature data is accumulated, and the accumulated temperature data is transmitted to the outside in response to a reading request signal from the outside is disclosed in Patent Document 3 (Japanese Published Patent Application No. S63-133027).

Furthermore, a sheet polyimide heater that can be bent and deformed in accordance with the shape of the surface of an object to be heated is disclosed in Patent Document 4 (Japanese Published Patent Application No. 2004-355882).

Furthermore, a technique in which a heat generating supporter to be attached to a body includes fibrous bodies, an electrode, and a sheet heat generating element a resistor element of which includes a resin component is disclosed in Patent Document 5 (Japanese Published Patent Application No. 2006-342449).

SUMMARY OF THE INVENTION

It is an object of this invention to provide a sheet having a heat generating function for warming a portion necessary to be warmed at the right time at any place indoors and outdoors.

Alternatively, it is an object of this invention to provide a sheet having a protecting function for preventing low temperature burns even if the sheet is attached to a body and in contact with human skin is provided. Alternatively, a sheet for supporting body temperature maintenance.

Alternatively, it is an object of this invention to provide a thin and lightweight sheet having a heat generating function and is suitable for carrying.

A flexible sheet which includes a plurality of heat generating circuits insulated from each other is placed at a position distant from an electric power transmission device within a range in which non-contact electric power transmission is possible. At least a circuit that can receive electric power without contact and a heat generating circuit electrically connected to the circuit that can receive electric power without contact are formed over the flexible sheet. Further, an adhesion means for fixing the flexible sheet to part of the surface of a living body is provided. Since the most surface of the living body, e.g., the surface of human body, has a curved surface, the flexible sheet can be firmly stuck on, so that the surface of the living body can be efficiently heated. The heat generating circuit is a circuit for heating by generating a heat of more than or equal to 30° C. and less than 60° C. on the surface of the sheet to be in contact with the part of the surface of the living body.

In specific, the sheet includes a plastic film, an antenna circuit formed over fibrous bodies, a circuit that converts a radio wave received by the antenna circuit into electric power, and a heat generating circuit electrically connected to the circuit that converts a radio wave received by the antenna circuit into electric power; the heat generating circuit generates heat by using electric power obtained in the circuit which converts a radio wave into electric power.

The sheet can generate heat as long as it is within a range where radio waves transmitted from a transmission device of radio waves can reach. The sheet can generate heat at any place indoors and outdoors by carrying a battery built-in transmission device, without being limited to a fixed-type transmission device provided with a wiring code from an outlet.

In addition, since ranges where radio waves can reach differ depending on the frequency of a radio signal transmitted from the transmission device, a frequency of a radio signal is necessary to be selected as appropriate in accordance with usage. Specifically, a radio signal in a frequency band of 135 kHz or lower, an ISM (industrial science and medical) frequency band, an RF band, a UHF band, or the like is used. Alternatively, by using a radio signal at a frequency of 5 kHz to 300 kHz, the sheet attached to a skin can be heated even in the water.

Note that a radio wave in this specification refers to a kind of electromagnetic wave and does not refer to an electromagnetic field, light, and an X-ray.

The antenna circuit converts a carrier wave supplied from the transmission device into an AC electric signal. The antenna circuit preferably has a rectifier circuit.

Note that there is no particular limitation on the shape of an antenna that can be used for this invention. Therefore, as a transmission method of a signal applied to the antenna circuit in the transmission device, an electromagnetic coupling method, an electromagnetic induction method, a radio wave method, or an optical method can be used. In this invention, an electromagnetic coupling method, an electromagnetic induction method, or the radio wave method is preferably used as a signal transmission method. A practitioner may select the transmission method as appropriate in consideration of usage. In addition, an antenna having an appropriate length and shape in accordance with a transmission method may be provided.

In addition, the circuit and the heat generating circuit are preferably covered with the plastic film or the fibrous bodies to be protected. When terminal portions and connected portions of the circuit are not covered but are exposed, short circuit can be caused. In particular, when the circuit is in contact with a skin, there is a concern that a human body gets an electric shock because the human body has a certain level of conductivity and moisture such as sweat may cause short circuit. As a material of the plastic film, a resin material (e.g., polyester, polypropylene, polyvinyl chloride, polystyrene, polyacrylonitrile, polyethylene terephthalate, nylon, or polyurethane) can be used. Typically, a plastic substrate formed of thermoplastics such as a PVF (polyvinyl fluoride) film or an acrylic resin film is used. In order to make a flexible film, the thickness of the film is preferably 200 to 500 μm.

A surface to be in contact with human skin is preferably formed by using a material having high thermal conductivity. For example, a synthetic resin formed of polypropylene, polyphenylene sulfone, polypropylene sulfone, polycarbonate, polyetherimide, polyphenylene oxide, polysulfone, or polyphthalamide is preferably used. Of these resins listed above, polyphenylene sulfone has a high thermo conductivity of 0.4 W/m·K. Alternatively, a plastic film to which a low-melting metal or a ceramics is added to impart the plastic film with high thermal conductivity can be used. Further alternatively, a plastic film in which a polylactic acid resin contains carbon fiber can be used.

A surface that is close to the transmission device which emits radio waves is preferably formed of a material that is unlikely to absorb radio waves, such as a plastic film, e.g., a polylactic acid resin, a polyester resin, or polyvinylchloride resin. Alternatively, when a heat insulating material (e.g., polyethylene resin or polyurethane resin) having low thermal conductivity is used as the surface that is close to the transmission device, heat radiation from the surface which is close to the transmission device of radio waves can be prevented, whereby the surface to be attached to the human skin can be efficiently heated.

As the fibrous bodies, woven fabric or a nonwoven fabric which uses fiber of an organic compound or an inorganic compound, or paper can be used. Typically, high-strength fiber can be used as the fibrous bodies. As the high-strength fiber, specifically, fiber having strong tensile modulus or Young's modulus is used. In the case where paper is used as the fibrous body, a feel that is kind to human skin can be obtained and body fluid such as sweat can be absorbed. In addition, a flexible sheet such as a sponge or silicon rubber may be stacked in order to give flexibility to a portion to be in contact with the skin. The fibrous body and the flexible sheet can also function as heat transmission buffering layers, improve thermal retention effect, and prevent a local portion which generates a high heating temperature from directly being in contact with the skin.

When high-strength fiber is used as the fibrous body, even when a local pressing force is added to a circuit, the force is dispersed over the entire fibrous body and a stretch of part of the circuit can be prevented.

In addition, as a heat generating element which is part of the heat generating circuit, metal foil formed of a metal having electric resistance, a strip-shaped metal thin film, or one or more metal wires can be used. As a material of the metal having electric resistance, chromium, tin, an alloy of chromium or tin, Nicrome (Registered trademark), Kanthal (Registered trademark), Inconel (Registered trademark), cast iron, stainless steel, or the like can be used.

Alternatively, not being limited to thin films or wires, the heat generating circuit may have a structure in which a pair of electrodes is provided and a resin to which conductive particles such as carbon black are added, an insulating film, or a semiconductor film is provided between the pair of electrodes; and when a current flows through the pair of electrodes, the heat generating circuit generates heat by Joel's heat. When the sheet is bent or the heat generating circuit is one long metal wire, there is a concern that disconnection is caused; however, by interposing a material between the pair of electrodes, the heat generating circuit can have resistance to bending. Further alternatively, the circuit formed over the sheet may be used as the heat generating element or part of the heat generating element, without being limited to the structure of interposing a material between the pair of electrodes. When the circuit formed over the sheet functions as part of the heat generating element, the circuit over the sheet can support a rise of temperature in the heat generating element. In that case, since there is a temperature difference between heat generation in the circuit and heat generation in the heat generating element, a heat equalizing material (a liquid state, a gel state, or the like) is preferably provided between the skin and the heat generating element, and the skin and the circuit. Note that if the plastic film or a fibrous body provided on the surface to be in contact with human skin is a material that can adequately equalize heat, a heat equalizing material is not necessary to be formed.

When the circuit which converts a radio wave received by the antenna circuit into electric power generates heat to function as the heat generating circuit, a simpler structure can be obtained.

In order to prevent heat generation for a long time of more than 6 hours and heat generation of 60° C. or higher, a limiter connected in series with the heat generating circuit is preferably provided.

Also, there is no particular limitation on the number of limiters in this invention, and at least one limiter may be included in a pair of circuits. Moreover, in the pair of circuits including the heat generating circuit and the limiter, there is no particular limitation on whether the limiter is provided on a high potential power source side or a low potential power source side; however, the limiter is preferably provided on a side to which current flows (i.e., a side which is closer to the higher potential power source side than the heat generating element).

Here, the limiter is a current control means including a circuit or the like in which one or more kinds of elements are combined, and is provided for controlling current so that an excessive amount of current does not flow to the heat generating element. For example, the limiter may be formed of one transistor, or a circuit formed of a combination of a plurality of elements such as a transistor and a diode.

In the case of using a sheet in which the temperature of the heat generating element does not get more than 60° C. for even a moment, the limiter is not necessary.

It is said that low temperature burns are caused when a heat source is in contact with the same position for approximately 1 minute at around 60° C., for approximately 3 minutes at around 50° C., and for approximately 6 hours at around 45° C.

Thus, low temperature burns are prevented by further providing an automatic temperature adjustment function for the sheet. The sheet includes the antenna circuit over the plastic film or the fibrous body, the circuit that converts a radio wave received by the antenna circuit into the electric power, a temperature sensor circuit, and the heat generating element electrically connected to the circuit that converts a radio wave received by the antenna circuit into electric power. Temperature is measured by the temperature sensor circuit by using the electric power obtained in the circuit which converts a radio wave into electric power, and whether the heat generating element generates heat or not is controlled based on temperature data obtained.

In order to control whether the heat generating element generates heat or not based on the temperature data obtained, a control circuit is preferably provided for the sheet. Heat generation in the heat generating element is automatically controlled by comparing the temperature data and temperature data set in a memory by using a CPU and the body temperature maintenance of a sheet wearer is supported.

Further, by providing a transmission circuit for the sheet, the temperature data measured by the temperature sensor circuit is transmitted to the transmission device of radio waves, so that the transmission device can control the heat generation. For example, when temperature data that exceeds a certain temperature is transmitted to the transmission device from the sheet, the heat generation in the sheet can be stopped by stopping transmission of radio waves to the sheet.

In the case of using a flexible sheet which includes a plurality of heat generating circuits insulated from each other, the transmission device sequentially selects a heat generating circuit to be heated from the plurality of generation circuits one by one. By sequentially heating selected heat generating circuits, one position is not continuously heated so that low temperature burns may be prevented.

Further, in order to prevent low temperature burns, a Peltier device may be provided for the sheet so that temperature is controlled.

Further, by further providing an amplifier circuit for the sheet, a large amount of electric power can be obtained without contact.

In order to reduce noise the various circuits provided over the sheet are preferably formed over the same substrate by using a thin film element such as a thin film transistor. In addition, when a thin film element such as a thin film transistor is used, a sheet with a surface which is more even than that of an IC chip can be provided. Further, by forming the various circuits over the same substrate and by providing a plurality of contact portions, the circuits are surely connected to each other.

As described above, various circuits may be formed over the sheet; however, since the amount of electric power obtained without contact has limitations, a charging circuit or an electric power generating circuit may be provided to obtain electric power. As long as the charging circuit or the electric generating circuit can be formed over the flexible sheet, there is no particular limitation. Typically, a capacitor, a secondary battery, a solar cell, or the like can be used.

Although Patent Document 1 discloses the technique of mounting the transmission/reception circuit or the non-contact electric power module on sports goods, using the sports goods while charging by the non-contact electric power module and using the sheet by being in contact with human skin are not assumed. This invention is greatly different from Patent Document 1 in that heat is generated in the sheet while signals from the non-contact electric power module or the transmission device are received and that the sheet is in contact with human skin. However, the sheet in this invention is not limited to being in contact with skin and the skin can be heated even through clothes as long as the clothes are made of thin cloth and there is not a big gap between the clothes and the skin.

A sheet having a heat generating function of warming a portion necessary to be warmed at the right time at any place indoors and outdoors can be realized as long as signal from the transmission device can reach. In addition, a sheet having a heat generating function of warming a portion necessary to be warmed at the right time at any place indoors and outdoors can be realized by carrying a portable small-size transmission device.

In the case where the sheet having a heat generating function is attached, since a circuit which automatically adjusts the surface temperature of wearer's skin to which the sheet is attached is mounted, low temperature burns can be prevented.

DETAILED DESCRIPTION OF THE INVENTION

Embodiment modes of this invention are described below.

Embodiment Mode 1

Figure 1A:
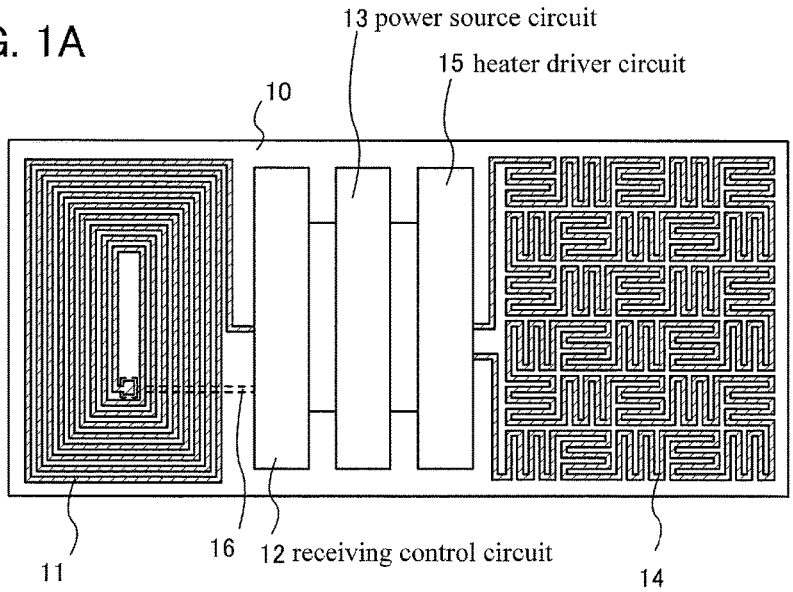
FIG. 1A is a top view of a sheet of this invention and FIG. 1B is a cross-sectional view of the sheet of this invention when it is used.

FIG. 1A is a simplified diagram of the structure of a sheet having a heat generating function in this invention.

An antenna 11, a receiving control circuit 12 electrically connected to the antenna 11, a power source circuit 13 connected to the receiving control circuit 12, a heater driver circuit 15 electrically connected to the power source circuit 13, and a heater 14 electrically connected to the heater driver circuit 15 are formed over a sheet 10.

As a material of the sheet 10, a heat insulating material is preferably used; and a fibrous body or a resin is used. In this embodiment mode, a polyethylene terephthalate resin is used as the material of the sheet 10.

In the case of using an electromagnetic coupling method or an electromagnetic induction method (for example, a band of 135 kHz or lower, or a 13.56 MHz band) as a transmission method, a conductive film which functions as the antenna 11 is formed to have a circular form (for example, a loop antenna) or a helical form (for example, a spiral antenna) in order to utilize electromagnetic induction that occurs with changes in electric field density.

Although a coiled antenna is used here, there is no particular limitation on the shape of the antenna as long as the antenna is designed in accordance with frequency and a circuit layout. In addition, the shape of the conductive film which functions as an antenna is not limited to the linear shape, and the conductive film may be formed into a curve, a serpentine shape, or a shape of combination thereof in consideration of the wavelength of radio waves.

An AC signal inducted by a radio wave received by the antenna 11 is converted into a DC signal in the receiving control circuit 12. The receiving control circuit 12 includes at least a rectifier circuit having a diode and a smoothing capacitor. In this specification, the antenna 11 and the receiving control circuit 12 are referred to as an antenna circuit.

A voltage which is half-wave rectified and smoothed in the receiving control circuit 12 is input to the power source circuit 13 and electric power is generated. The power source circuit 13 includes at least a reference voltage circuit and a buffer amplifier. Note that the reference voltage circuit and the buffer amplifier are formed of semiconductor elements such as thin film transistors and MOS transistors.

The electric power generated in the power source circuit 13 is converted into a signal corresponding to the heater 14 through the heater driver circuit 15, and current flows to the heater 14 to generate heat. A heat generating circuit of the sheet 10 is the heater 14. If the signal output from the power source circuit 13 can be directly input to the heater 14 to generate heat, the heater driver circuit 15 is not necessary. If the power source circuit 13 can adequately generate heat when the current flows because the power source circuit 13 includes the semiconductor elements and the semiconductor elements have electric resistance, the power source circuit can be regarded as a heat generating circuit; therefore, the heater 14 is not necessary.

For safety, the heater control circuit 15 is preferably used to prevent low temperature burns caused when the sheet 10 is in contact with skin and generates heat.

For example, when a comparison circuit is provided in the heater driver circuit 15 and the comparison circuit determines the electric power generated in the power source circuit 13 as a value smaller than a certain value, current flows to the heater 14 to generate heat. If the resistance value of the heater 14 which generates heat changes in accordance with temperature, the heater driver circuit 15 may be provided with a control switch that stops current supply to the heater 14 when the resistance value becomes higher than a certain value. Alternatively, the heater driver circuit 15 can be provided with a limiter for preventing long-time heat generation and unusual heat generation. The heater driver circuit 15 includes at least a limiter, a control switch, or a comparison circuit.

By providing the heater driver circuit 15 which prevents low temperature burns, the heater can be automatically controlled without a temperature sensor.

Since the heater 14 can be manufactured with the same material and in the same process as the antenna 11, the heater 14 formed of a metal film with a serpentine shape is used; however, this invention is not particularly limited thereto. If the number of manufacturing steps can be increased, the material of the heater can be interposed between a pair of electrodes. If the material of the heater is interposed between the pair of electrodes, a plurality of lower electrode wirings is provided in parallel, a plurality of upper electrode wirings is provided in a direction perpendicular to a direction in which the lower electrode wirings are provided, and heat generating materials are provided for portions where the lower electrode wirings and the upper electrode wirings intersect with each other. Alternatively, heat can be generated by arranging a plurality of heaters with the heat generating materials interposed between the pair of electrodes in an active matrix, and providing switching elements for respective heaters to select the heater.

Further, an organic EL material can be used as the heat generating material. An organic EL material interposed between the pair of electrodes can emit light by application of voltage and generate heat by heat inactivation. Accordingly, when one of the pair of electrodes is a transparent conductive film and a light-transmitting material is used as the material of the sheet, optical light can be emitted to the outside of the sheet and a user can recognize heat generation by a current flow to the heater. In addition, defect can be visually checked so that the sheet can be changed.

Figure 1B:
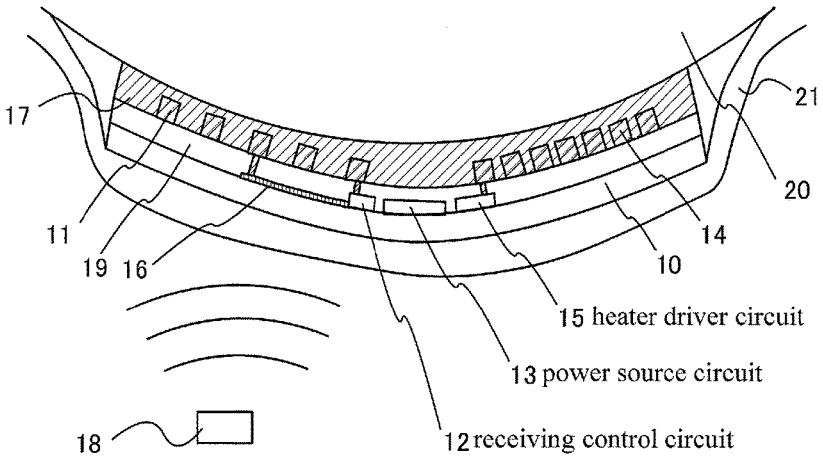

FIG. 1B is a cross-sectional view illustrating one example of usage of the sheet having a heat generating function in this invention.

A wiring 16 connected to the receiving control circuit 12 is provided over the sheet 10, and the antenna 11 and the heater 14 are provided over an insulating film 19. One terminal of the antenna is connected to the receiving control circuit 12 by the wiring 16. As shown in FIG. 1B, when each of the receiving control circuit 12, the power source circuit 13, and the heater driver circuit 15 includes a semiconductor element such as a diode and a thin film transistor, a capacitor, or a resistor, the receiving control circuit 12, the power source circuit 13, and the heater driver circuit 15 can be formed over the sheet in the same manufacturing process. As a semiconductor material used for the diode, the thin film transistor, or the like, a compound semiconductor or an oxide semiconductor such as ZnO (zinc oxide), a-InGaZnO (amorphous-indium gallium zinc oxide), IZO (indium zinc oxide), ITO (indium tin oxide), or SnO (tin oxide) as well as silicon.

In addition, a protective layer 17 which covers the antenna and the heater is provided and comes to be in contact with a skin 20 that is part of a body. A resin material having high thermal conductivity is preferably used as the protective layer 17, and the protective layer 17 can also function as a heat transmission buffering layer. Further, the antenna 11 is also heated by heat generation in the heater through the protective layer 17, whereby temperature can be further equalized in the protective layer 17 with the antenna 11. Although in FIG. 1A, the antenna 11 and the heater 14 are provided with a gap therebetween, temperature uniformity can be further achieved by reducing the gap. For example, the antenna may be provided for the outside edge of the sheet, and the heater at the center, so that the heater may be surrounded by the antenna. In this manner, it is useful that both the heater 14 and the antenna 11 are covered with the protective layer formed of the resin material having high thermal conductivity.

In addition, the protective layer 17 also functions as a planarizing film. When the protective layer 17 is formed over the sheet in the same manufacturing process as the sheet, since unevenness is hardly generated on a surface due to the protective layer 17, skin does not feel uncomfortableness with a contact surface with the protective layer 17 when it is in contact with the skin.

In order to fit the surface of the sheet having a heat generating function to a curved surface of the skin 20 that is part of the body, the sheet is fixed by being pushed with a fastening means 21. The fastening means 21 is a mounting fixture such as a supporter, a glove, socks, or an underwear, which is in contact with skin. The sheet may be fixed by providing an attaching means such as a sticky tape between the protective layer 17 and the skin 20 without using the fastening means 21. Alternatively, a sticky tape such as a double-stick tape may be used as the fastening means 21, and the skin 20 and a sticky tape can be fixed outside the sheet having a heat generating function.

Alternatively, in order to prevent an attached portion from misaligning due to movement of the body, the sheet may be further fixed by being sewn into the fastening means 21 with a needle and thread. Since the sheet having a heat generating function of this invention is so thin that a sewing machine can be used, the sheet is not obvious even if it is sewn into the fastening means 21. In addition, the sheet having a heat generating function of this invention is so light that it does not impede movement of a human because the weight of the sheet does not change so much even if it is sewn into the fastening means 21. Moreover, since electric power is wirelessly supplied to the sheet having a heat generating function of this invention, a wiring code, a switch button, and the like are not necessary and electrodes are not exposed due to coverage with the protective layer 17; therefore, electric shock, leakage, or the like does not occur on the body even when water or sweat attaches.

Figure 2A:
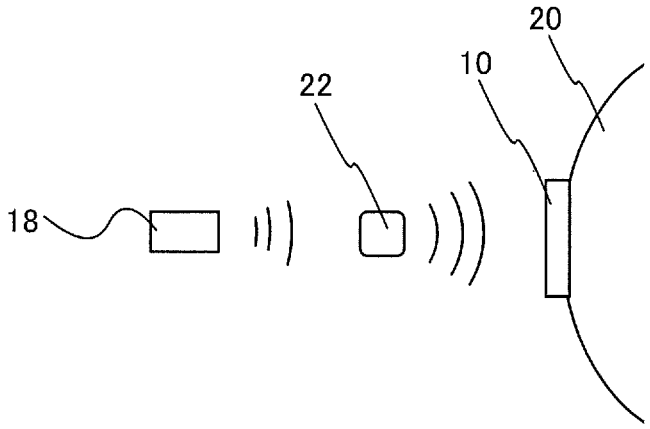
FIG. 2A is a diagram illustrating a positional relation among a transmission device, a sub-transmission device and a sheet.

In this embodiment mode, since the electromagnetic induction method is employed, a communication distance is several tens centimeters. Radio waves are transmitted from the transmission device 18 within that region of the communication distance. As the transmission device 18, a fixed-type transmission device, a portable-type transmission device, or a plurality of transmission devices may be used. As shown in FIG. 2A, a distance of a transmission range can be extremely increased as follows; a radio wave transmitted from the main transmission device 18 is received by a sub-transmission device 22 provided between the transmission device 18 and the sheet 10; and the sheet 10 fixed on the skin 20 receives the radio wave transmitted from the sub-transmission device 22. Note that the sub-transmission device 22 includes a battery and a transmission/reception circuit.

Note that the transmission device 18 preferably has an off-timer function that prevents continuous heating for 6 hours or more for avoiding low temperature burns. In this embodiment mode, since the transmission device 18 may only has a function of transmitting, it can have a simple structure.

In this embodiment mode, since the electromagnetic induction method is employed, radio waves from the transmission device 18 go around and a heat generating circuit of a sheet provided on part of the body may be heated.

Although FIG. 1A illustrates only minimum components, an example in which a temperature sensor is further formed over the same sheet for fine automatic adjustment of temperature is shown below.

Figure 2B:
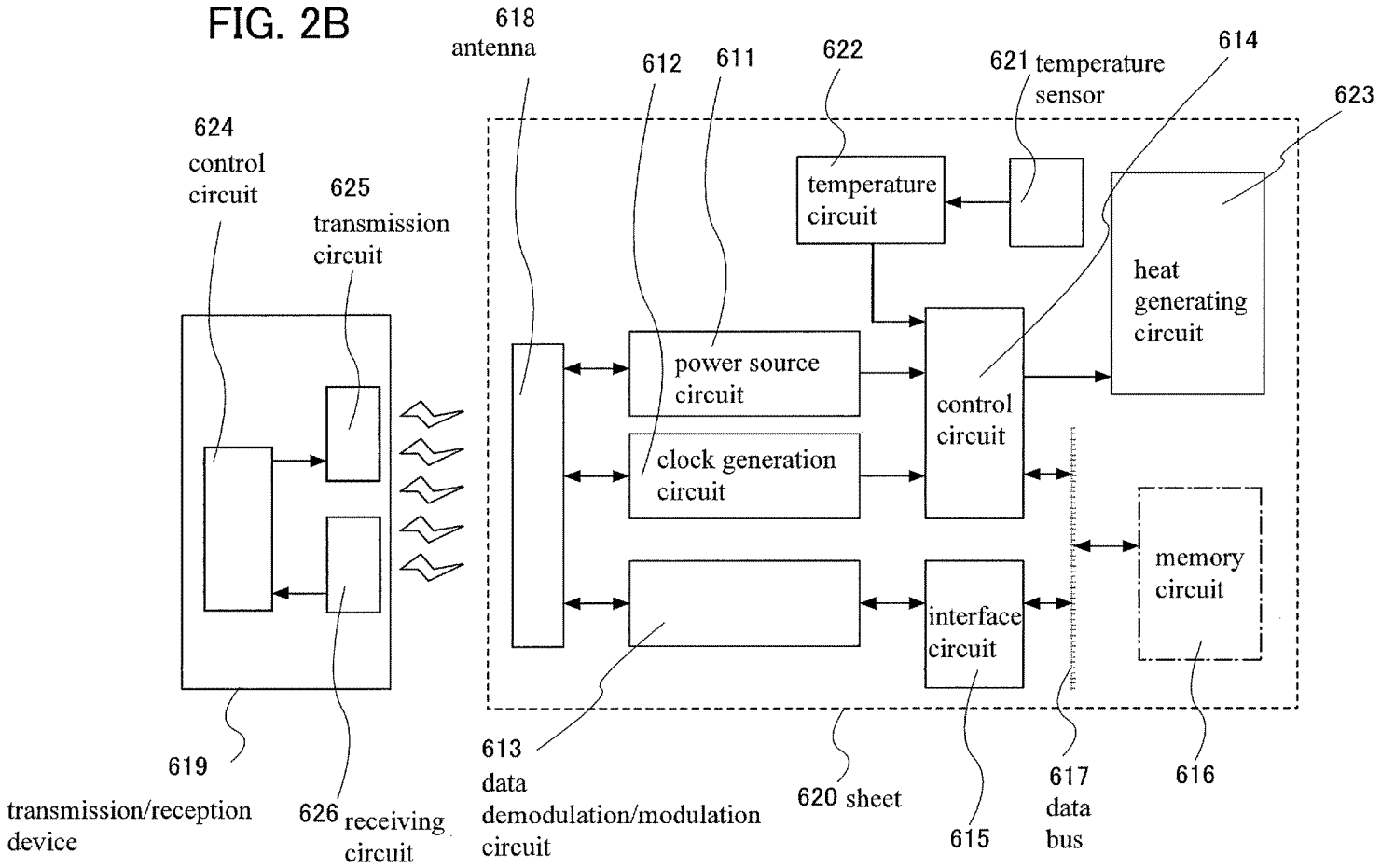
FIG. 2B is a block diagram.

As shown in FIG. 2B, a sheet 620 having a heat generating function of this invention has a function of data communication without contact, and includes a power source circuit 611, a clock generation circuit 612, a data demodulation/modulation circuit 613, a control circuit 614 for controlling a heat generating circuit and the like, an interface circuit 615, a memory circuit 616, a data bus 617, an antenna 618, a temperature sensor 621, a sensor circuit 622, and a heat generating circuit 623.

The power source circuit 611 is a circuit that generates various power sources, based on AC signals input from the antenna 618, to be supplied to respective circuits in the sheet 620. The clock generation circuit 612 is a circuit that generates various clock signals, based on the AC signals input from the antenna 618, to be supplied to the respective circuits in the sheet 620. The data demodulation/modulation circuit 613 has a function of demodulating or modulating data for communication between the data demodulation/modulation circuit 613 and a transmission/reception device 619. The control circuit 614 has a function of controlling the memory circuit 616. Alternatively, the control circuit 614 may include a CPU. The antenna 618 has a function of transmitting/receiving of radio waves. The transmission/reception device 619 includes a transmission circuit 625, a control circuit 624 that communicates with the sheet, controls the sheet, and processes data on the communication and the control, and a receiving circuit 626. Note that the structure of the sheet 620 is not limited to that described above. For example, another component such as a limiter circuit for power source voltage or a Peltier device may be added.

Note that the memory circuit 616 corresponds to one or a plurality of memories selected from a DRAM, an SRAM, a mask ROM, a PROM, an EPROM, an EEPROM, and a flash memory.

Figure 2C:
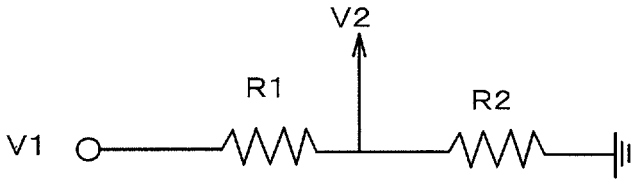
FIG. 2C is an equivalent circuit diagram of a temperature sensor.

As the temperature sensor 621, a resistor, a thermoelectromotive force element, a thermistor, or the like is used. The temperature sensor 621 may be manufactured in the same process as a thin film transistor so as not to increase the number of steps. A wiring of a stacked-layer structure is formed by using a metal material that is the same as that of a gate electrode, a source wiring, a drain wiring, or the like of the thin film transistor (aluminum, chromium, molybdenum, or an alloy thereof). Since the wiring can be regarded as a resistor whose resistance value varies in accordance with temperature with respect to kinds of stacked metal materials, the wiring can be referred to as a temperature sensor. The width, length, and film thickness of the temperature sensor may be determined based on resistivity and a temperature coefficient of the metal material used. An equivalent circuit of the temperature sensor is shown in FIG. 2C.

A first resistor R1 and a second resistor R2 are connected in series between a terminal to which a driving voltage V1 is applied and a ground. The first resistor R1 corresponds to the temperature sensor. Since the resistance value of the first resistor R1 changes in accordance with temperature, an output voltage V2 also changes. A wiring with a stacked-layer structure in which the rate of change of the output voltage V2 is proportional to the temperature is preferably used. Note that the second resistor R2 is a fixed resistor.

Another sensor (a optical sensor using a photoelectric conversion element) may be mounted instead of the temperature sensor. The sensor circuit 622 detects the amount of change in impedance, reactance, inductance, voltage, or current, and performs analog/digital conversion (A/D conversion) to output a signal to the control circuit 614.

An example of operation of the sheet 620 which performs fine automatic temperature adjustment is shown. Electric power is generated in the power source circuit 611 by using a radio signal transmitted from the transmission circuit 625 in the transmission/reception device 619 through the antenna 618 to generate heat in the heat generating circuit 623 by using part of the electric power. Moreover, change in voltage or current that is a base of temperature data is detected by the temperature sensor 621 or the sensor circuit 622 by using another part of the electric power and analog/digital conversion is performed to output a signal to the control circuit 614. After the signal is stored in the memory circuit 616, the signal is demodulated/modulated in the data demodulation/modulation circuit 613 and is transmitted to the transmission/reception device 619 from the antenna. Then, the transmission/reception device 619 which has received the transmitted signal in the receiving circuit 626 calculates temperature by the control circuit 624 and determine whether transmission of the radio signal is continued or stopped.

The operation described above is an example of automatic temperature adjustment by measuring temperature in real time and by performing data transmission/reception with the transmission/reception device 619.

In the case of heating various portions by using a plurality of sheets having a heat generating function, transmission of radio signals from the transmission/reception device is stopped when one sheet has a high temperature in the operation described above. Therefore, heat generation in all the sheets is stopped.

Thus, by providing a battery that can be charged with electricity and a CPU to the sheet having a heat generating function, operation in which heat generation in each of the plurality of sheets is automatically adjusted without depending on the transmission/reception device even if the plurality of sheets is used, is preferable.

An example of operation in a sheet that independently performs automatic temperature adjustment is shown. Electric power is generated in the power source circuit 611 by using a radio signal transmitted from the transmission circuit 625 in the transmission/reception device 619 through the antenna 618. Change in voltage or current that is a base of temperature data is detected by the temperature sensor 621 or the sensor circuit 622 by using part of the electric power and analog/digital conversion is performed to output a signal to the control circuit 614. The signal is compared with data stored in the memory circuit 616 by the CPU provided in the control circuit 614 to calculate an accurate temperature, whereby whether current flows to the heat generating circuit 623 or not is determined. When the current does not flow to the heat generating circuit 623, the battery which can be charged with electricity and is provided in the power source circuit 611 is charged with the current. Since larger amount of electric power is necessary in the case of mounting the CPU, the power source circuit 611 is preferably provided with a battery which can be charged with electricity.

As the battery which can be charged with electricity, a device called a secondary battery or a storage battery that converts electric energy obtained from an external power source into chemical energy and accumulates it, and use the energy as electric power again as necessary is used. For example, a lithium battery, preferably, a lithium polymer battery that uses gel electrolyte, lithium ion battery, or the like is used. Since it is important for a battery to be thin, a battery formed into a sheet form is preferably used. However, when a battery is provided, the number of manufacturing steps and manufacturing cost are increased. Thus, a capacitor with high capacitance that can be formed in the same process as the semiconductor element may be used instead of the battery. A capacitor is a device that can store charge by attractive force between electricity when two insulated conductors get closer and one of the two conductors has positive charge and the other of the two conductors has negative charge.

Even when the CPU is provided in the control circuit 614, the plane area of the CPU formed of a thin film transistor as disclosed in Non-Patent Document 1 is 14 mm×14 mm, which is adequately smaller than the plane area of the antenna or the heater.

However, it is difficult for the sheet which independently performs automatic temperature adjustment to have an off timer function. Thus, the control circuit 624 in the transmission/reception device 619 preferably has the off timer function for preventing low temperature burns due to continuous heating for a long time.

Alternatively, by storing identification data in the memory circuit in each sheet, heat generation can be selectively stopped only in a sheet where communication of identification data is performed, which is selected by the control circuit 624 in the transmission/reception device 619. In the identification data communication, a radio wave whose frequency is different from that of a radio wave for electric power supply for the sheet is used. In this manner, programming of heating time and a temperature rise in each sheet can be performed by the control circuit 624 in the transmission/reception device 619. Note that when a radio wave having a different frequency is used, an antenna and a rectifier circuit are formed for the radio wave.

In this embodiment mode, although the example of forming the circuits including the thin film transistor and the like are formed over the sheet and forming the antenna and the heater thereover is shown, this invention is not particularly limited to this. After the antenna and the heater on the sheet are formed, a silicon chip which includes a MOS transistor and uses SOI technology or the like may be provided. It is needless to say that solder containing lead, which is harmful to human cannot be used for connection in mounting. Thus, it is preferable that the antenna and the heater be electrically connected by using lead-free solder, anisotropic conductive adhesive, or the like. However, since a connected part between the antenna and the silicon chip thus mounted is weak against bending, the connected part is preferably protected by being fixed from above and bottom with flat plates formed of hard materials. The silicon chip and the connected part each have an area of approximately 1 mm×1 mm, which is adequately smaller compared to the size of the whole sheet and the size of the antenna. Thus, the flat plates can be made smaller and flexibility of the whole sheet is not easily influenced.

Embodiment Mode 2

In Embodiment Mode 1, the example of employing the electromagnetic induction method as the transmission method is shown. Here, an example of employing a microwave method (for example, a UHF band (a band of 860 to 960 MHz), a 2.45 GHz band, or the like) will be described below. In the case of a microwave method, a communication distance can be several meters. However, the directivity of the microwave method is stronger than that of the electromagnetic induction method, whereby radio waves are absorbed in the body and moisture of human, which is a problem.

In the case where a microwave method which is a kind of radio wave method is employed as a transmission method, the length and shape of a conductive film that serves as an antenna may be set as appropriate in consideration of the wavelength of a radio wave used for signal transmission. The conductive film that serves as an antenna may be formed into a linear shape (e.g., a dipole antenna), a flat shape (e.g., a slot antenna or a patch antenna), or the like.

An appropriate length of the antenna varies depending on a frequency for receiving signals. For example, if the frequency is 2.45 GHz, the length should be about 60 mm (half of the wavelength) if a half-wavelength dipole antenna is provided for the antenna and about 30 mm (one-fourth of the wavelength) if a monopole antenna is provided for the antenna. When the frequency is 900 MHz, which is particularly preferable, reception is performed by a radio wave method using an antenna with a length greater than or equal to 100 mm and less than or equal to 150 mm.

In this embodiment mode, an example is shown in which a plurality of heat generating circuits are provided over one flexible sheet.

Figure 3A:
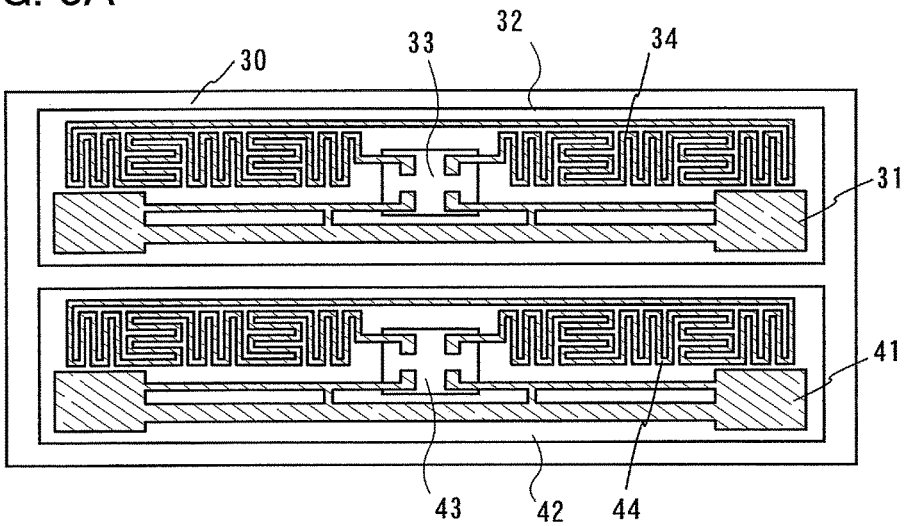
FIG. 3A is a top view of a sheet of this invention.

In FIG. 3A, two heaters are provided over one sheet 30. The heaters are electrically insulated from each other. A first heater 34 is electrically connected to a first circuit portion 33, and a first antenna 31 and the first circuit portion 33 are electrically connected to each other. The first antenna 31, the first circuit portion 33, and the first heater 34 are provided between a first film 32 formed of a resin material that is harder than the sheet 30, and the sheet 30. The first film 32 is provided in order to suppress a breakdown of elements and disconnection which are caused by bending. In specific, the first film 32 is useful when the shape of the antenna is long and thin as shown in FIG. 3A.

In this embodiment mode, the first antenna 31 and the first heater 34 are provided over the first film 32 in advance, thus formed first film 32 and the sheet 30 provided with the first circuit portion 33 are attached to each other, and the first film 32 and the sheet 30 come to have conduction by using a material containing a conductive material. The first circuit portion 33 includes a transistor using thin single crystal silicon manufactured by SOI technology, FSA (fluidic self assembly) (Registered trademark) technology, or the like.

FSA technology is technology for distributing silicon chips in the water over a film having a depressed portion on its surface to arrange the silicon chips on the depressed portion. Moreover, SOI technology is technology for using a single crystal semiconductor film formed over an insulating film by a SIMOX (separation by implanted oxygen) method, SOI (silicon on insulator), as an active layer of a transistor.

A second heater 44 is electrically connected to a second circuit portion 43, and a second antenna 41 and the second circuit portion 43 are electrically connected to each other. The second antenna 41, the second circuit portion 43, and the second heater 44 are provided between a second film 42 formed of a resin material that is harder than the sheet 30, and the sheet 30. The second film 32, is also provided in order to suppress a breakdown of elements and disconnection which are caused by extreme bending.

When the sheet 30 shown in FIG. 3A is bent, the sheet 30 can be greatly bent between the first film 32 and the second film 42. By making the whole sheet not to be freely bent and limiting a direction in which the sheet is bent at some level in this manner, disconnection in the antenna and the heater is prevented and reliability of connected part in the circuit portion can be improved. For example, when the connected part in the circuit portion is provided at the center, a breakdown of element due to extreme bending can be prevented.

Figure 3B:
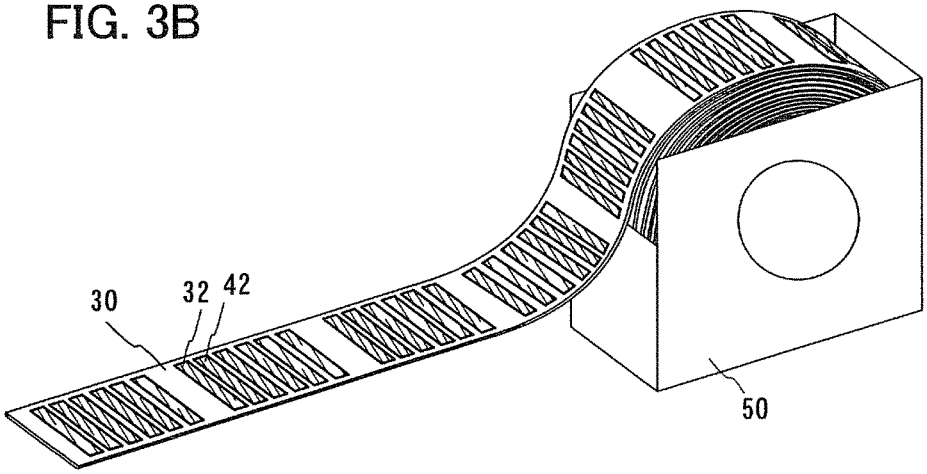
FIG. 3B is a perspective view when a plurality of sheets is stored to have a tape form.

In storing the sheet 30 with a limitation on a direction in which the sheet is bent, disconnection in the antenna and the heater does not easily occur even when the sheet is rolled up in a storage container 50, as shown in FIG. 3B. Moreover, by providing an attaching means on one surface of the sheet 30, the sheet can be used like a tape.

Note that in the case of the microwave method, radio waves are absorbed in a human body. Thus, when the human body is disposed between the antenna and the transmission device, the antenna cannot receive the radio waves.

Figure 3C:
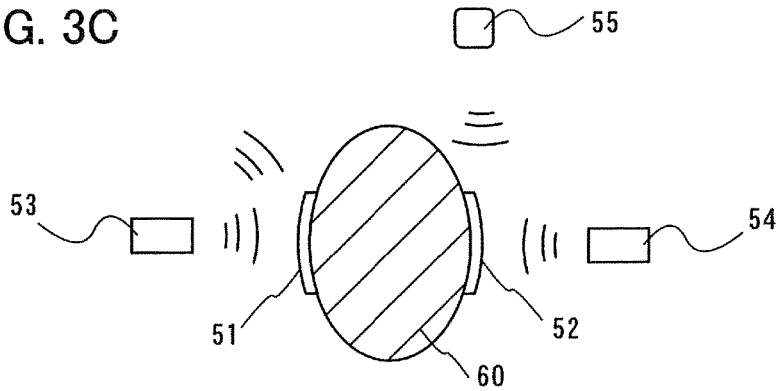
FIG. 3C is a diagram illustrating a positional relation between a transmission device and a sub-transmission device.

This will be explained with reference to FIG. 3C illustrating an arm of a human. When a first sheet 51 is provided for one side of a human arm 60 and a second sheet 52 is provided for the other side of the human arm 60, microwaves transmitted from a transmission device 53 can heat the first sheet 51 but it is difficult to transmit the microwaves to the second sheet 52. Accordingly, when both the first sheet 51 and the second sheet 52 are to be heated at the same time, an additional transmission device 54 is provided. In addition, if the first sheet 51 and the second sheet 52 may be alternately heated, the transmission device 53 is moved as appropriate so that the microwaves are received.

Alternatively, as shown in FIG. 3C, a sub-transmission device 55 may receive the radio waves transmitted from the main transmission device 53 and transmit the radio waves, so that the microwaves can go around the body so as not to be absorbed in the body. Alternatively, instead of the sub-transmission device 55, a reflection plate that reflects microwaves may be provided to make the microwaves go around the body.

Figure 4A:
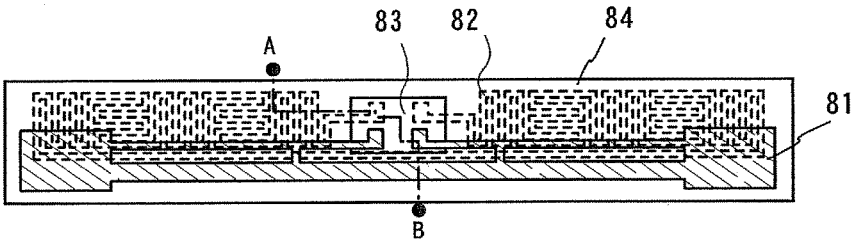
FIG. 4A is a top view of a sheet of this invention.
Figure 4B:
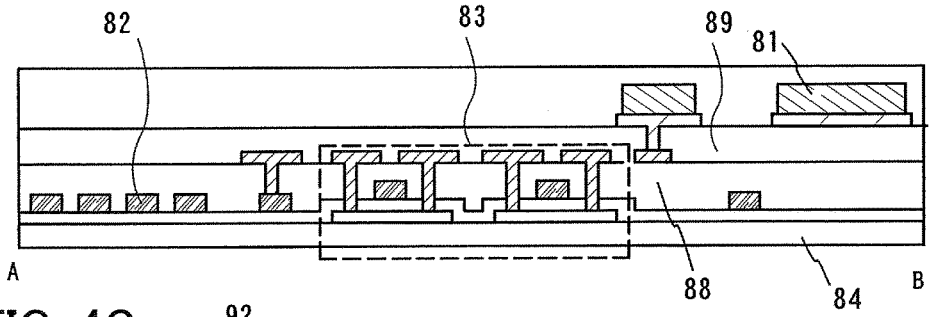
FIG. 4B is a cross-sectional view of the sheet of this invention.

When the sheet is downsized without being limited to the arrangement shown in FIG. 3A, arrangement shown in FIG. 4A-4B may be used. FIGS. 4A and 4B illustrate a structure in which a heater 82 and an antenna 81 are partly overlap with each other with insulating films 88 and 89 interposed therebetween. FIG. 4B is a cross-sectional view along chain line A-B in FIG. 4A. A circuit portion 83 is formed of circuits including a thin film transistor over a sheet 84 and a heater 82 is manufactured in the same steps as a gate electrode of the thin film transistor. As compared to FIG. 3A, the structure shown in FIG. 4A can be narrowed and the number of heaters 82 provided per unit area can be increased.

Figure 4C:
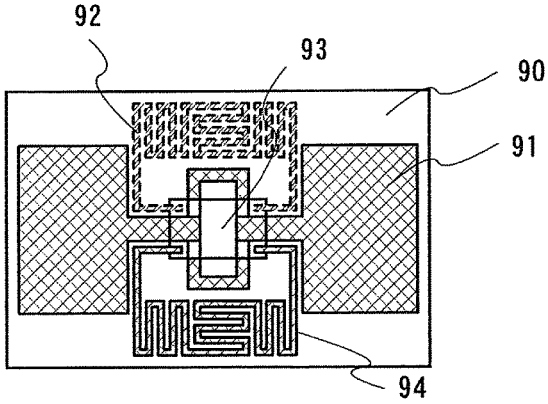
FIG. 4C is a top view of a sheet of this invention.

Moreover, arrangement shown in FIG. 4C may be used. In FIG. 4C, an example is shown in which a first heater 92 is formed over a sheet 90 and an antenna 91 and a second heater 94 are formed of the same material. A circuit portion 93 is electrically connected to each of the antenna 91, the first heater 92, and the second heater 94. Since the first heater 92 and the second heater 94 are provided on different sides, an object to be heated can be differently heated. For example, after the object to be heated is weakly heated by using only a heater that is far from the object, it can be strongly heated by using the both heaters. In the case of warming human skin, stimulus and stress can be further reduced by gradually heating instead of abruptly heating.

As shown in FIG. 4C, by providing two heaters on difference sides and allocating the circuit portion between the two heaters provided above and below, electrostatic breakdown can be suppressed.

Figure 4D:
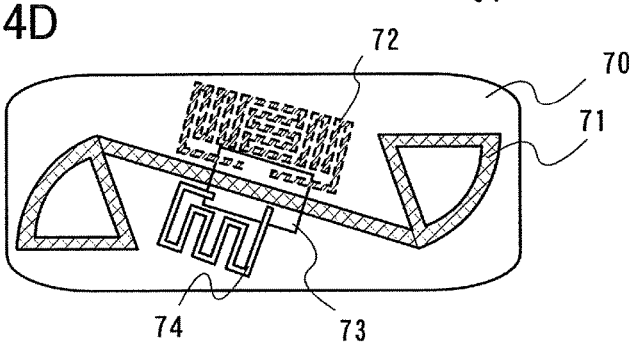
FIG. 4D is a top view of a sheet of this invention.

In addition, FIG. 4D includes a temperature sensor 74 by way of example. A circuit portion 73 formed over a sheet 70 is electrically connected to the temperature sensor 74, a heater 72, and an antenna 71. By providing the temperature sensor 74, heating temperature of the heater can be adjusted. Moreover, there is no limitation on the shape of the sheet, and the sheet 70 whose outside edge is all a curve may be employed, as shown in FIG. 4D.

Embodiment Mode 3

In this embodiment mode, one example is shown below in which after a circuit including a thin film transistor and a capacitor is formed over a substrate and the circuit is separated from the substrate by a separation technique, the circuit is provided over a flexible substrate to manufacture a semiconductor device, specifically a sheet having a heat generating function.

Figure 5A:
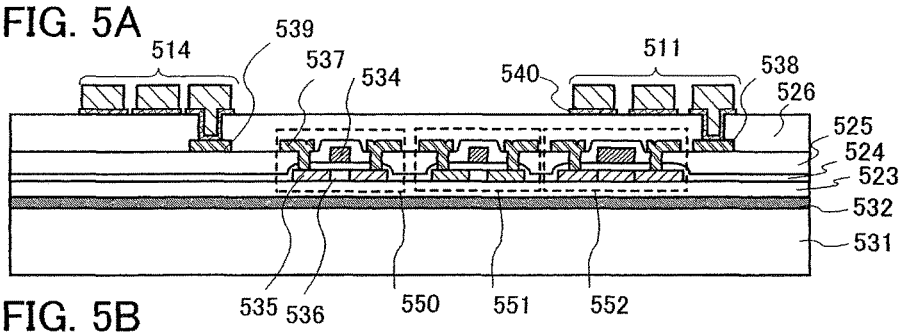
FIGS. 5A to 5D are cross-sectional views illustrating a manufacturing process of a sheet in this invention.

First, as shown in FIG. 5A, a substrate 531 having an insulating surface is prepared. As the substrate 531, a substrate with rigidity required for an apparatus for manufacturing a thin film transistor and heat resistance that withstands a processing temperature is selected. For example, as the substrate 531, a glass substrate, a quartz substrate, a silicon substrate, a metal substrate, or a stainless steel substrate can be used. In this embodiment mode, a glass substrate of 600 mm×720 mm is used as the substrate 531 and a plurality of thin film transistors is manufactured by using one glass substrate so that sheets having a heat generating function are mass-produced at low cost.

Next, a separation layer 532 is formed over the surface of the substrate 531. The separation layer 532 is formed to separate a stacked-layer body formed later from the substrate 531. By using technology disclosed in Japanese Published Patent Application No. 2003-174153, a TFT with silicon used as an active layer can be formed over a flexible substrate or a film. In this embodiment mode, the separation layer 532 is formed of a tungsten film. A method for forming the TFT over a flexible plastic film is not limited to that disclosed in Japanese Published Patent Application No. 2003-174153. For example, following methods can be employed: a method in which a separation layer is formed between a layer to be separated and a substrate, and the separation layer is removed by solution (etchant) or etching gas to separate the layer to be separated and the substrate; and a method in which a separation layer formed of amorphous silicon (or polysilicon) is formed between a layer to be separated and a substrate, and hydrogen contained in amorphous silicon is discharged by irradiating the amorphous silicon with laser light passing through the substrate, so that voids are generated and the layer to be separated and the substrate are separated.

An insulating film 523 forming a base insulating film of a thin film transistor is formed over a surface of the separation layer 532. The insulating film 523 can be formed as a single layer film or a multi-layer film using a material selected from silicon oxide, silicon nitride, silicon nitride oxide ($SiO_xN_y$), diamond-like carbon (DLC), aluminum nitride (AlN), or the like, to prevent contamination of the thin film transistor. Films of these materials can be formed by a CVD method or a sputtering method. However, in the case where a film that does not contain oxygen is used as the insulating film 523 which is in contact with the tungsten film as the separation layer 532, after the surface of the tungsten film is oxidized by thermal oxidation treatment, oxygen plasma treatment, or oxidation treatment by solution having high oxidizability, such as ozone water to obtain a tungsten oxide layer, the insulating film 523 is formed and separation is performed in a later step.

Next, a semiconductor film is formed over the insulating film 523 and an insulating film 524 is formed so as to cover the semiconductor film. In this embodiment mode, a polysilicon film, a microcrystalline silicon film, or a single crystal silicon film is used as the semiconductor film. In addition, a thin single crystal silicon film that is obtained from a silicon substrate may be bonded to the insulating film 523 by SOI technology. As a semiconductor material of the semiconductor film, as well as silicon, a compound semiconductor or an oxide semiconductor such as ZnO, a-InGaZnO, IZO, ITO, or SnO can be used. The semiconductor film forms a channel formation region 536 and impurity regions 535 of a TFT are formed. In addition, the semiconductor film forms an electrode of a capacitor 552.

In this embodiment mode, since a top-gate TFT is employed, the insulating film 524 serves as a gate insulating film. Moreover, the insulating film 524 also serves as a dielectric of the capacitor 552. The insulating film 524 is a single-layer film or a multi-layer film of silicon oxide or silicon nitride oxide ($SiO_xN_y$) and may have a thickness of more than or equal to 10 nm and less than or equal to 60 nm. These insulating films can be formed by a CVD method or a sputtering method.

Next, a first conductive layer 534 is formed over the insulating film 524. A conductive film forming the first conductive layer 534 may be a single layer conductive film or a multilayer conductive film. For the conductive film, a film formed of a metal of an element selected from tantalum, tungsten, titanium, molybdenum, aluminum, copper, and chromium; a film formed of an alloy combining such elements; or a film including a nitride of the element can be used, for example. Also, silicon or the like that gains conductivity by being added with phosphorus or the like as a dopant can be used. In FIGS. 5A to 5D, a gate electrode of the TFT and an electrode of the capacitor are shown as the first conductive layer 534. Moreover, by adding impurities to a semiconductor film, the n-type and p-type impurity regions 535 which function as source regions and drain regions of a p-channel TFT 550 and an n-channel TFT 551, and an impurity region to be the electrode of the capacitor are formed. The addition of the impurity can be done before or after forming the first conductive layer 534. Alternatively, it can be done both before and after forming the first conductive layer 534. By the impurity region 535 being formed, a channel formation region 536 is also formed in the semiconductor film.

Next, an insulating film 525 is formed over the entire surface of the substrate 531. A second conductive layer 537 is formed over the insulating film 525. The insulating film 525 is an interlayer film that separates the first conductive layer 534 and the second conductive layer 537. An inorganic insulating film formed of silicon oxide, silicon nitride, or silicon oxynitride ($SiO_xN_y$) can be used for the insulating film 525. In addition, an organic resin film of polyimide, acrylic, or the like, or a film containing siloxane can be used. The organic resin may be either photosensitive or nonphotosensitive. The insulating film 525 can be formed of any of these insulating materials in a single-layer or multilayer structure.

The second conductive layer 537 may be a single-layer conductive film or a multi-layer conductive film. For the conductive film, a film formed of an element selected from tantalum, tungsten, titanium, molybdenum, aluminum, copper, and chromium; a film formed of an alloy in which such elements are combined; or a film including a nitride of any of the elements can be used, for example.

The second conductive layers 537 are wirings of the p-channel TFT 550 and the n-channel TFT 551, and also form a connecting electrode 538 with an antenna, and a connecting electrode 539 with a heat generating element simultaneously. In FIGS. 5A to 5D, only the wirings connected to the TFTs and the connecting electrodes for connection with an antenna 511 and a heat generating element 514 are shown. In addition, before forming the second conductive layer 537, a contact hole is formed in the insulating films 524 and 525 to connect the second conductive layer 537 with the first conductive layer 534 and the semiconductor film in lower layers. Note that a plurality of contact holes is provided to prevent disconnection due to bending and to make electrical connection in a plurality of portions.

Next, an insulating film 526 is formed over a circuit portion including the p-channel TFT 550, the n-channel TFT 551, and the capacitor 552. The insulating film 526 is preferably formed as a planarizing film with which a flat surface can be formed by smoothing out unevenness caused by the circuit portion. Accordingly, it is preferable to use a film containing siloxane, or an organic resin film of polyimide, acrylic, or the like, which can be formed by applying or printing a material and then curing this material. In addition, instead of a single layer structure, the insulating film 526 can have a multi-layer structure with such an organic resin film or the like as an upper layer and an inorganic insulating film of silicon oxide, silicon nitride, silicon oxynitride ($SiO_xN_y$), or the like as a lower layer.

Note that a resistor, a diode, and the like besides the TFT and the capacitor are simultaneously provided for the circuit portion including the p-channel TFT 550, the n-channel TFT 551, and the capacitor 552. By using the p-channel TFT 550 and the n-channel TFT 551, a CMOS circuit can be formed. In addition, a CPU can be provided for the circuit portion. The thickness of the circuit portion can be formed to be thin, about 3 μm to 5 μm. Note that a structure of the TFT in the circuit portion is not limited to the structure in FIG. 5A. For example, the TFT in the circuit portion can have a multi-gate structure in which a plurality of gates is provided for one semiconductor layer. Also, a high resistance region that is like a low concentration impurity region can be formed adjacent to a channel formation region in the semiconductor layer. Furthermore, the structure may be a bottom-gate structure instead of a top-gate structure.

Next, a third conductive layer 540 is formed over the insulating film 526. By providing the third conductive layer 540, electrical connection with the antenna and the heat generating element to be formed later can be surely made. In addition, the third conductive layer 540 is a conductive film for improving adhesiveness, such as a titanium film or a molybdenum film. When the adhesiveness is adequate, the third conductive layer 540 is not necessary.

Next, the antenna 511 and the heat generating element 514 are formed. The antenna 511 and the heat generating element 514 can be formed by a method of forming a conductive film by a sputtering method or an evaporation method and then processing the conductive film into a desired shape by etching, or by a method that does not use etching such as a screen printing method or a droplet discharging method. A thinner antenna 511 and the heat generating element 514 can be manufactured by the former method. For the antenna 511 and the heat generating element 514, copper, silver, gold, aluminum, titanium, chromium, or the like may be used. Further, when a resin is contained in addition to such a metal or an alloy thereof, the antenna 511 and the heat generating element 514 which have resistance to bending can be achieved. A manufacturing method is not particularly restricted, and a sputtering method, a screen printing method, a droplet discharging method, or the like can be used. In this embodiment mode, the antenna 511 and the heat generating element 514 are formed by selectively depositing chromium using an evaporation mask.

In this embodiment mode, the example is shown in which the antenna 511 and the heat generating element 514 are formed at the same time to reduce the number of steps. However, a material which is appropriate for the function of each of the antenna 511 and the heat generating element 514 can be used. After the heat generating element 514 of an epoxy resin containing silver is formed by screen printing, the antenna 511 may be formed using silver nanopaste by an ink jet method.

When an aluminum film is used as a material for the antenna 511 and a molybdenum film is used as the third conductive layer 540, a wiring with a stacked-layer structure of the aluminum film and the molybdenum film can be separately formed as a temperature sensor, without increasing the number of steps. By providing the temperature sensor, the heat generating element can be finely controlled. In this embodiment mode, the maximum of current which flows to the heat generating element is limited by providing a limiter for the circuit portion.

Next, a protective layer 527 that covers the antenna 511 and the heat generating element 514 is formed. The protective layer 527 protects an element layer to suppress damage to the circuit portion, the antenna, and the like in a separation step to be described later. A material that can be formed by a simple formation method such as an application method, a spray method, or the like is preferably used as the protective layer 527. As the material that satisfies this requirement, a resin is preferably used to form the protective layer 527. For example, a resin material having high thermal conductivity is preferable as the resin to be used for the protective layer 527. As the resin material, a polyphenylene sulfone resin can be given. By using the resin material having high thermal conductivity for the protective layer 527, heat generated in the heat generating element can be efficiently obtained and temperature distribution can be made even. The protective layer 527 has adequate mechanical strength to protect the antenna 511 and the heat generating element 514 and can secure the flatness of a surface.

In this manner, manufacturing of the stacked-layer body including the circuit portion over the substrate 531 is completed. A cross-sectional view at this stage is shown in FIG. 5A. Note that the circuit portion includes at least a circuit that converts radio waves received by the antenna into electric power (a resonant circuit, a power source circuit, or the like) and a control circuit that controls heat generation in the heat generating element (a limiter circuit or the like). The circuit that converts radio waves into electric power is electrically connected to the antenna through the contact hole, and the control circuit that controls heat generation in the heat generating element is electrically connected to the heat generating element through the contact hole.

Figure 5B:
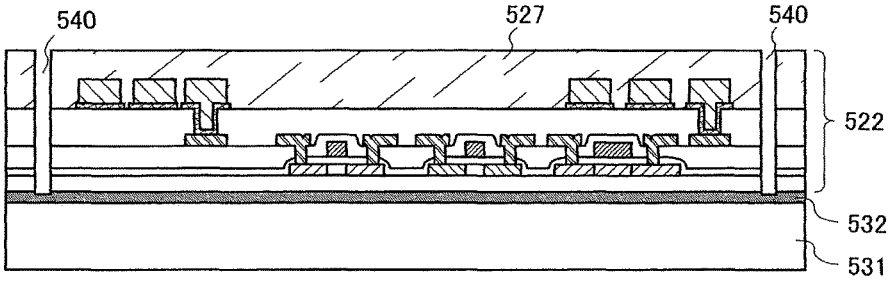

Next, as shown in FIG. 5B, opening portions 540 are formed. The opening portions 540 are formed to reach the separation layer 532 or to penetrate through the separation layer 532. As a forming method of the opening portions 540, a method in which the stacked-layer body is physically cut with a dicer, a wire saw, or the like; a method in which the stacked-layer body is cut by laser ablation using laser beam irradiation; or a method in which the opening portions 540 are formed by etching, can be employed. Of these methods, the method of cutting by laser ablation is preferable because of short time processing and a smaller impulse to the antenna 511 and the circuit portion as compared to other methods.

In addition, by providing the opening portions 540, side surfaces of the stacked-layer body is formed. Also, since the stacked-layer body is cut together with the protective layer 527, a side surface of the stacked layer films composed of the insulating films 523 to 526 can be formed to be aligned with a side surface of the protective layer 527.

Figure 5C:
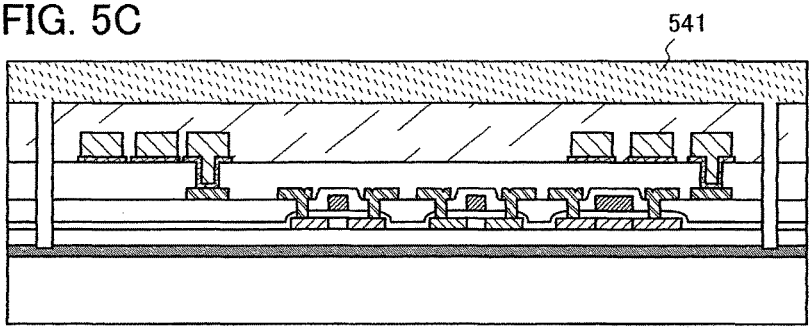

Next, as shown in FIG. 5C, a supporting base material 541 is attached on the top surface of the protective layer 527. The supporting base material 541 is a base material for supporting a stacked-layer body 522 until the stacked-layer body 522 is transferred to a flexible base material 513. Accordingly, a base material that can easily be removed from the stacked-layer body 522 is selected for the supporting base material 541. For example, for the supporting base material 541, a base material having a property in which adhesiveness is strong in a normal state but becomes weak when heat is applied or is irradiated with light, may be used. For example, a heat-peeling tape whose adhesiveness is weakened by heat, a UV-peeling tape whose adhesiveness is weakened by ultraviolet rays, or the like may be used. Alternatively, a weak adhesion tape with weak adhesiveness in a normal state, or the like can be used.

Moreover, although the example is shown here in which the supporting base material 541 is attached after the opening portions 540 are formed, opening portions which penetrate the supporting base material 541 may be formed after the supporting base material 541 is attached.

Figure 5D:
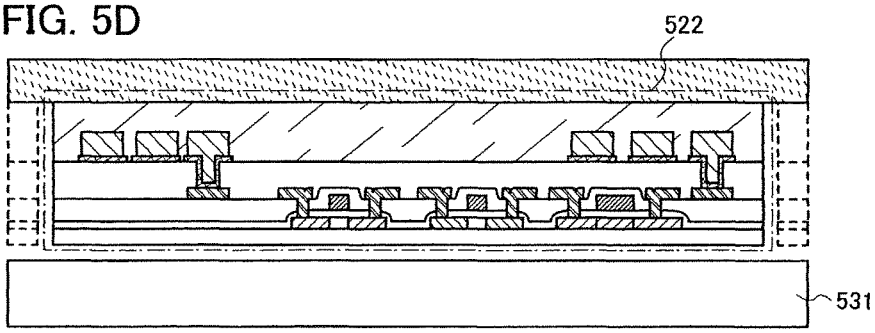

Next, the stacked-layer body 522 is separated from the substrate 531 by weakening the bonding strength of molecules inside the separation layer 532 and at its interface with a layer that is in contact with the separation layer 532. In this embodiment mode, the stacked-layer body 522 is separated by a physical means. The physical means refers to a dynamic means or a mechanical means, which changes some kind of dynamic energy (mechanical energy). The typical physical means refers to mechanical power addition (for example, peeling by a human hand or grip tool, or separation treatment by rolling a roller). By adding force to the support base material 541, the stacked-layer body 522 can be separated from the substrate 531 as shown in FIG. 5D.

As a method of weakening the bonding strength of the molecules inside the separation layer 532 or the like, there is a method of forming in advance a portion in the separation layer 532 where the bonding strength of the element is weak, or a method of forming the separation layer 532 and then treating it so that the bonding strength of the molecules becomes weak.

Further, by forming the opening portions 540, a shrinking force of the protective layer 527 is applied to the separation layer 532, which can promote separation at an interface between the separation layer 532 and the insulating film 523 or inside the separation layer 532.

Figure 6A:
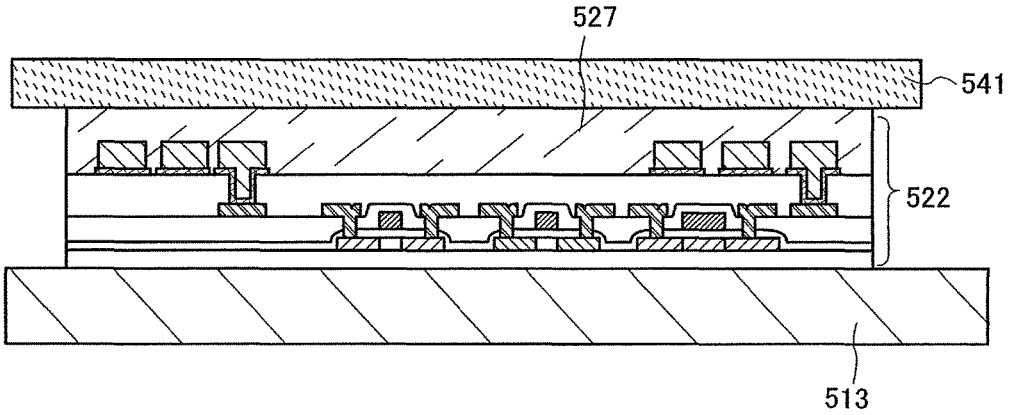
FIGS. 6A and 6B are cross-sectional views illustrating a manufacturing process of a sheet in this invention.

Next, as shown in FIG. 6A, a flexible base material 513 is fixed on the bottom surface of the stacked-layer body 522 from which the substrate 531 is separated, that is, the surface where the insulating film 523 is exposed. The flexible base material 513 has a stacked-layer structure of a base material film and an adhesion layer. As the base material film, a resin material such as polyester, polypropylene, polyvinyl chloride, polystyrene, polyacrylonitrile, polyethylene terephthalate, or polyamide can be used. As the base material film, an adhesive synthetic resin film such as an acrylic resin, an epoxy resin, a vinyl acetate resin, a vinyl copolymer resin, or a urethane resin can be used. In this embodiment mode, a heat insulating material with low thermal conductivity (a polyethylene resin) is used as the flexible base material 513 in order to efficiently obtain heat generated.

The flexible base material 513 has a function of smoothing the surface of the stacked-layer body 522 from which the substrate 531 is removed. For the flexible base material 513, a thin base material, with a base material film that has a thickness of 2 μm or more, with the total thickness (total thickness of the base material film and the adhesion layer) of the whole flexible base material 513 is less than or equal to 20 μm can be used.

Subsequently, the supporting base material 541 is separated from the stacked-layer body 522. Then, the flexible base material 513 is cut into a predetermined shape to make a plurality of stacked-layer bodies 522. Through the above-described procedure, a semiconductor device 501 shown in FIG. 6B is completed.

In the case where the flexible base material 513 is not cut, because the glass substrate of 600 mm×720 mm is used, a sheet in substantially the same size as the glass substrate can be manufactured.

Note that the surface of the semiconductor device 501 may be coated with powder of silicon dioxide (silica). By the coating, even when the semiconductor device 501 is in an environment with high temperature and high humidity, a water-resistance property can be secured. Also, the surface of the base material film may be coated with a conductive material such as indium tin oxide. By the coating material, accumulation of charge on the base material film can be prevented, and the circuit portion can be protected from static electricity. Furthermore, the surface of the base material film may be coated with a material that contains carbon as its main component (for example, diamond-like carbon). By the coating, strength is improved, and deterioration and break of a semiconductor device can be suppressed.

Figure 6B:
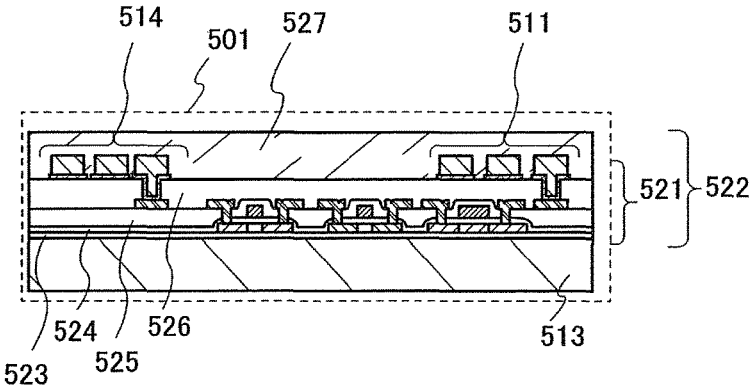

In addition, the antenna 511 shown in FIG. 6B is an antenna with a spiral structure. When the semiconductor device 501 is located in an electromagnetic field generated by communication signals from the transmission device, induced electromotive force is generated by the antenna 511 and the resonant circuit. The induced electromotive force is held by the capacitor 552 in the power source circuit. In addition, the potential of the induced electromotive force is stabilized by the capacitor 552, and supplied to each circuit in the circuit portion as power source voltage. Then, heat generation in the heat generating element 514 heats the protective layer 527 and also the antenna which is in contact with the protective layer 527, whereby a semiconductor device with even heating temperature distribution can be obtained.

In addition, although FIG. 6B shows the example in which the antenna 511 has the spiral structure, an antenna with a different structure can also be used. For example, as shown in Embodiment Mode 2, an antenna with a linear shape, such as a dipole antenna can be employed. The length, shape, size, and the like of the antenna are selected as appropriate depending on the communication distance or the like of the semiconductor device 501.

Moreover, although the heat generating element 514 shown in FIG. 6B is an example of a metal wire having electrical resistance which is formed in the same steps as the antenna, the heat generating element can also be formed by using a metal wiring formed in the same step as the second conductive layer 537, a metal wiring formed in the same step as the first conductive layer 534, a wiring formed using the same semiconductor film as the impurity region 535, or the like. Further, by electrically connecting these metal wires through a contact hole, the heat generating element can be formed of a plurality of materials so that the heat generating element has high electrical resistance. Alternatively, although the number of steps increases, a heat generating circuit having a different structure can be employed instead of the heat generating element 514.

Figure 7:
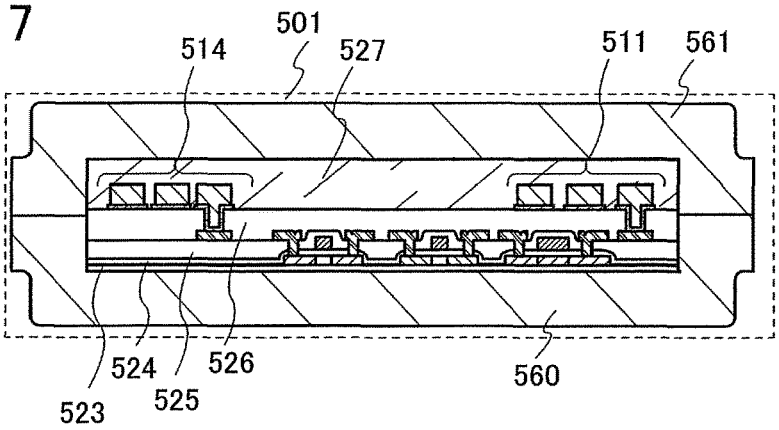
FIG. 7 is a cross-sectional view of a sheet of this invention.

Moreover, as shown in FIG. 7, not only the top and bottom surfaces but also side surfaces of the stacked-layer body 522 can be sealed with a pair of flexible base materials 560 and 561 by using a laminating apparatus. For each of the flexible base materials 560 and 561, a thin base material, with a base material film that has a thickness of 2 μm or more, with the total thickness of the flexible base material (total thickness of the base material film and the adhesion layer) is less than 20 μm can be used. By selecting a flexible base material with such a thickness, even when two flexible base materials are used as shown in FIG. 7, the thickness of the semiconductor device 501 can be made to be 50 μm or less, or even thinner, as in 40 μm or less.

Figure 8A:
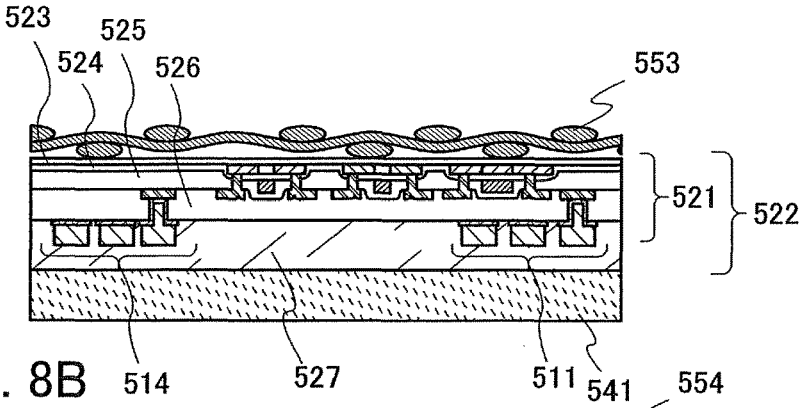
FIGS. 8A to 8C are cross-sectional views illustrating a manufacturing process of a sheet in this invention.

Alternatively, fibrous bodies can be used instead of the flexible base material. A method for using a fibrous body will be described with reference to cross-sectional views shown in FIGS. 8A and 8B. After the step of FIG. 5D, a fibrous body 553 is provided over an exposed surface of the insulating film 523. A view showing this stage is FIG. 8A. The fibrous bodies 553 are a woven fabric or an unwoven fabric formed of high-strength fiber of an organic compound or an inorganic compound. The fibrous bodies 553 covers the entire exposed surface of the insulating film 523. As high-strength fiber, specifically, fiber having strong tensile modulus or Young's modulus can be used. As typical examples of high-strength fiber, polyvinyl alcohol fiber, polyester fiber, polyamide fiber, polyethylene fiber, aramid fiber, polyparaphenylene benzobisoxazole fiber, glass fiber, carbon fiber, and the like can be given. As the glass fiber, glass fiber using E glass, S glass, D glass, Q glass, or the like can be used. It is to be noted that the fibrous bodies 553 may be formed from one kind of the above-described high-strength fibers or a plurality of the above-described high-strength fibers.

The fibrous bodies 553 may be formed using a woven fabric which is woven using bundles of fiber (single yarn) (hereinafter, referred to as yarn bundles) for warp yarns and weft yarns, or a nonwoven fabric obtained by stacking yarn bundles of plural kinds of fiber in a random manner or in one direction. In the case of a woven fabric, a plain-woven fabric, a twilled fabric, a satin-woven fabric, or the like can be appropriately used.

The yarn bundle may have a circular shape or an elliptical shape in cross section. As the yarn bundle of fibers, a yarn bundle of fibers may be used which has been subjected to fiber opening with a high-pressure water stream, high-frequency vibration using liquid as a medium, continuous ultrasonic vibration, pressing with a roller, or the like. A yarn bundle of fibers which is subjected to fabric opening has a large width, has a smaller number of single yarns in the thickness direction, and has an elliptical shape or a flat shape in its cross section. Further, by using a loosely twisted yarn as the yarn bundle of fibers, the yarn bundle is easily flattened and has an elliptical shape or a flat shape in cross section. Use of a yarn bundle having an elliptical shape or a flat shape in cross section in this manner can make the fibrous bodies 553 thinner. Accordingly, a thin semiconductor device can be manufactured. When the diameter of the yarn bundle is greater than or equal to 4 μm and less than or equal to 400 μm, or greater than or equal to 4 μm and less than or equal to 200 μm, the circuit portion can be protected.

In diagrams of this specification, the fibrous bodies 553 are shown as a woven fabric which is plain-woven using yarn bundles having an elliptical shape in cross section. Moreover, although the TFT is larger than the yarn bundles of the fibrous bodies 553 in the diagrams, the TFT is smaller than the yarn bundles of the fibrous body 553 in some cases.

Figure 8B:
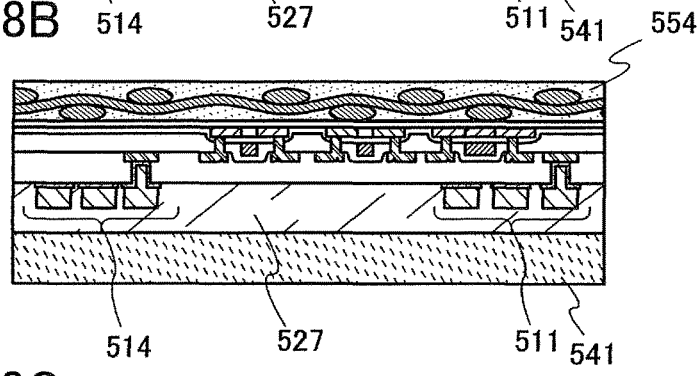

Next, as shown in FIG. 8B, an organic resin layer 554 is formed on the fibrous body 553 and the stacked-layer body 522. As the organic resin layer 554, a thermosetting resin such as an epoxy resin, an unsaturated polyester resin, a polyimide resin, a bismaleimide-triazine resin, or a cyanate resin can be used. Further, a thermoplastic resin such as a polyphenylene oxide resin, a polyetherimide resin, or a fluorine resin can be used. Furthermore, a plurality of the above-described thermosetting resin and thermoplastic resin may be used. When the above-described organic resin is used, the fibrous body can be firmly fixed to the element layer by thermal treatment.

As a method for forming the organic resin layer 554, a printing method, a cast method, a droplet discharge method, a dip coating method, or the like can be used.

At that time, the fibrous bodies 553 are impregnated with an organic resin contained in the organic resin layer 554. In other words, the fibrous bodies 553 are included in the organic resin layer 554. Thus, the adhesiveness between the fibrous body 553 and the organic resin layer 554 is increased.

Next, the organic resin layer 554 is heated to plasticize or cure the organic resin of the organic resin layer 554. In the case where the organic resin is an organic plastic resin, the organic resin which is plasticized is then cured by cooling to room temperature.

Then, the supporting base material 541 is separated from the stacked-layer body 522.

Through the above-described steps, the stacked-layer body 522 can be formed over the fibrous bodies 553. With the organic resin layer 554 including the fibrous bodies 553, reliability in high-temperature and humidity can be improved. Further, preferably, fibrous bodies 555 are provided on a surface where the protective layer 527 is exposed and an organic resin layer 556 is formed. In this case, a highly thermally-conductive filler is dispersed into the organic resin layer 556 or yarn bundles of the fibrous bodies 555. As the highly thermally-conductive filler, an aluminum nitride, a bromine nitride, a silicon nitride, alumina, or the like can be given. As the highly thermally-conductive filler, a metal particle such as silver or copper can also be given. The conductive filler is contained in the organic resin or the yarn bundles of fiber, whereby the heat generated in the heat generating element 514 can be easily discharged to the outside.

Paper can be used instead of the flexible base material. A method for embedding a plurality of semiconductor devices 501 in paper will be described with reference to cross-sectional views in FIGS. 9A to 9D. Paper in this embodiment mode is formed as multi-layer paper, and the plurality of semiconductor devices 501 is embedded between paper layers.

First, a paper material of pulp dissolved in water is prepared. The paper material is evenly stirred and then drained to form a wet paper web 571 (see FIG. 9A).

To improve interlayer strength, starch such as phosphate-esterified starch; cationic polyacrylamide; or the like is sprayed over one surface of the wet paper web 571. Subsequently, the semiconductor devices 501 are placed on the surface that is sprayed with starch or the like as an interlayer reinforcer (see FIG. 9B). Note that although in FIGS. 9A to 9D, an example in which three semiconductor devices 501 are embedded in one piece of paper is shown, more than three semiconductor devices 501 can be embedded in one piece of paper.

A wet paper web 572 that is prepared separately is placed over the wet paper web 571, and the wet paper webs 571 and 572 are pressed together and attached to each other. It is desirable that the surface of the semiconductor device 501 is hydrophilic so that the semiconductor device 501 fits well between the wet paper webs 571 and 572. Accordingly, it is preferable that a surface of the protective layer 527 is subjected to a plasma treatment, a corona treatment, or the like so that the surface is modified to have a hydrophilic property or to improve a hydrophilic property. The treatment of the surface of the protective layer 527 may be performed before or after cutting the stacked-layer body 522.

By drying the wet paper webs 571 and 572 after they are pressed together, paper 575 in which the semiconductor devices 501 are embedded between a paper layer 573 and a paper layer 574 is formed. Note that since the conductive layers of the antenna 511, the heat generating element 514, and the circuit portion in the semiconductor device 501 are each formed of a material having high reflectivity, when a color of the paper 575 is white or when the paper 575 is thin, there is concern that the embedded semiconductor devices 501 stand out. In order to make the semiconductor devices 501 not stand out, a surface of the antenna 511, a surface of the heat generating element 514, or a surface of a conductive layer is made to be uneven. By the unevenness on the surface of the heat generating element 514, the surface of the antenna 511, or the surface of the conductive layer, light is irregularly reflected at the surface, and the surface looks like it is white and turbid; consequently, an effect where the semiconductor devices 501 do not stand out is expected. For example, when aluminum is heated, a surface thereof becomes uneven.

Note that although in FIGS. 9A to 9D, the paper 575 is multi-layer paper with two layers, the paper 575 may be multi-layer paper with three or more layers. For a method of embedding the semiconductor device 501 in paper, a method of making multi-layer paper is preferably employed. This is because controlling a position where the semiconductor device 501 is to be embedded is easy. For example, in the method where the semiconductor device 501 is sunk in a raw material of paper dissolved in water, it is difficult to control the position in a thickness direction, and in order to control the position in the thickness direction, it is necessary to balance specific gravity of the semiconductor device 501 and weighing capacity of the paper, which makes it difficult to embed an the semiconductor device 501 in a variety of types of paper. On the other hand, in multi-layer papermaking, there is no problem in terms of controlling the position in the thickness direction.

Through the manufacturing method described above, the semiconductor device can be mass-produced using a large glass substrate and a unit price can be low so that the semiconductor device can be used for disposable goods. Specifically, in the case where a sheet is preferably changed from hygiene standpoint in the medical field, the cosmetic field, the food packing filed, or the like, this invention is useful. Note that a manufacturing floor of semiconductor devices is clean so that there are no problems in hygiene standpoint in the medical field, the cosmetic field, the food packing filed, or the like.

This embodiment mode can be freely combined with Embodiment Mode 1 or 2.

Embodiment Mode 4

Figure 10A:
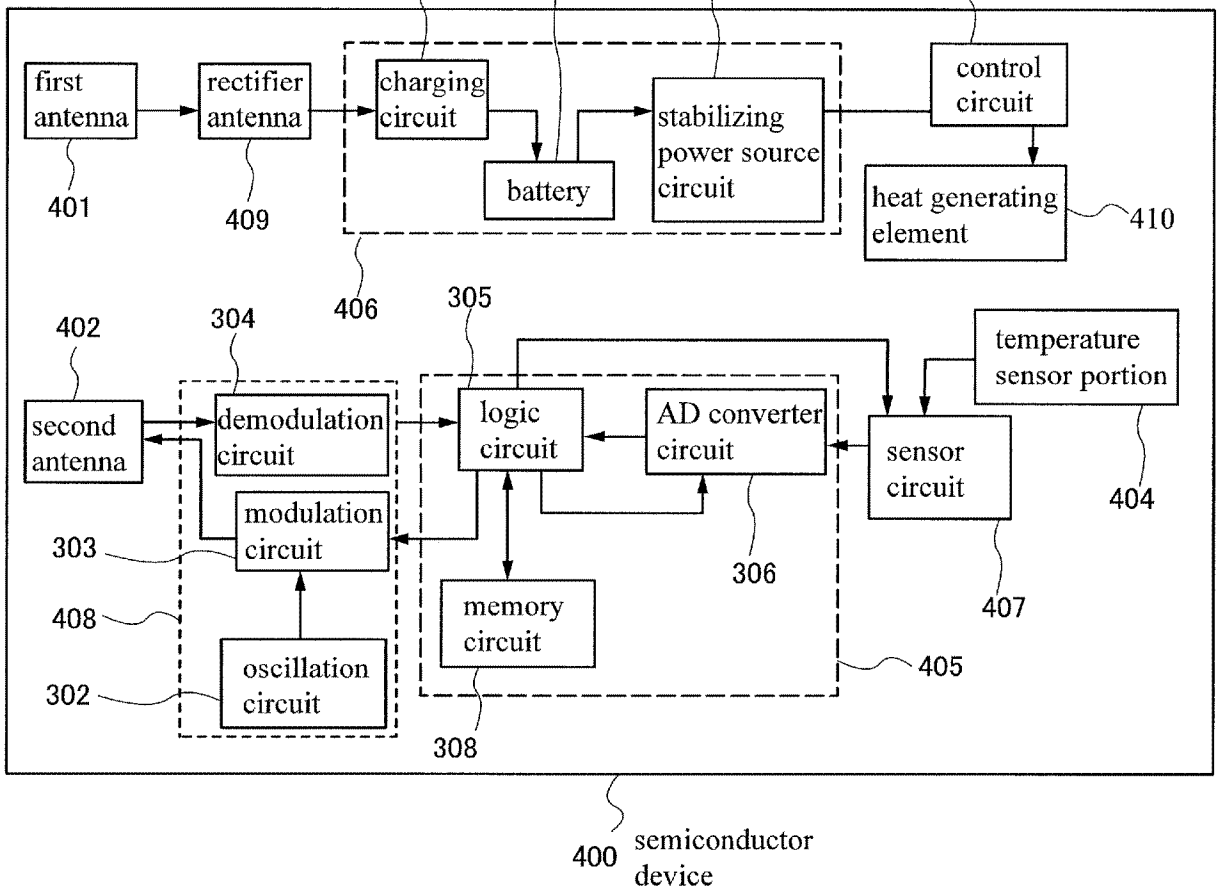
FIG. 10A is a block diagram and FIG. 10B is a top view of a sheet of this invention.

In this embodiment mode, an example in which a plurality of antennas is provided is shown. An example of a block diagram is shown in FIG. 10A.

A semiconductor device 400 includes a first antenna 401, a second antenna 402, a control circuit 403, a temperature sensor portion 404, a sensor circuit 407, a rectifier circuit 409, a heat generating element 410, an oscillation circuit 302, a modulation circuit 303, a demodulation circuit 304, a logic circuit 305, an AD converter circuit 306, a memory circuit 308, a charging circuit 310, a battery 311, and a stabilizing power source circuit 312.

In this embodiment mode, the first antenna 401 for receiving electric power and the second antenna 402 for receiving signals are provided. When a plurality of antennas having different functions are selectively used in this manner, electric power transmission and signal transmission can be conducted by using different radio frequencies. For example, power transmission can be conducted with radio waves having a frequency of 13.56 MHz by utilizing a magnetic field, while signal transmission can be conducted with radio waves having a frequency of 950 MHz by utilizing an electric field. By selectively using a magnetic field and an electric field, or the frequency, electric power can be transmitted only a short distance, while signal can be transmitted both short and long distances. If electric power transmission is conducted with a radio frequency of 950 MHz, there is a possibility that large amount of electric power is transmitted to a far place, which could cause interference with reception of other wireless devices. Therefore, when the distance of electric power transmission can be short, it is preferable to lower the frequency and use a magnetic field.

Operation of the semiconductor device 400 in this embodiment mode will be described below. An AC signal received by the first antenna 401 is half-wave rectified by a diode included in the rectifier circuit 409 and smoothed in a smoothing capacitor. By using this smoothed voltage, the charging circuit 310 operates to charge the battery 311. As the battery 311, a secondary thin film battery or a capacitor with high capacitance can be used.

As the battery 311, a lithium ion battery with a thickness of 1 μm to several μm which can be used as a flexible secondary battery is preferably used. The battery 311 is manufactured by depositing a collector thin film which is to be an electrode over a substrate. The collector thin film is required to have high adhesion to a negative electrode active material layer and have low resistance. In specific, aluminum, copper, nickel, vanadium, or the like can be used as the collector thin film. Then, the negative electrode active material layer is deposited over the collector thin film. As the negative electrode active material layer, vanadium oxide or the like is used. Then, a solid electrolyte layer is deposited over the negative electrode active material layer. As the solid electrolyte layer, lithium phosphate or the like is used. Then, a positive electrode active material layer is deposited over the solid electrolyte layer. As the positive electrode active material layer, lithium manganate or the like is used. Lithium cobaltate or lithium nickel oxide may also be used. A collector thin film to be an electrode is deposited over the positive electrode active material layer. The collector thin film is required to have high adhesion to the positive electrode active material layer and have low resistance. For example, aluminum, copper, nickel, vanadium, or the like can be used. Each of these thin film layers may also be formed using a sputtering technique or an evaporation technique. In addition, the thickness of each layer is preferably 0.1 to 3 μm.

Next, operation of a lithium ion battery in charging and discharging will be described. In charging, lithium ions are desorbed from the positive electrode active material layer. Then, the lithium ions are absorbed into the negative electrode active material layer through the solid electrolyte layer. At this time, electrons are released out of the positive electrode active material layer. In discharging, lithium is ionized and desorbed from the negative electrode active material layer. Then, the lithium ions are absorbed into the positive electrode active material layer through the solid electrolyte layer. At this time, electrons are released to outside from the negative electrode active material layer. In such a manner, the thin film secondary battery operates. With such a thin-film secondary battery, a compact and lightweight battery can be constructed.

An output voltage of the battery 311 is stabilized by the stabilizing power source circuit 312, and the stabilized voltage is supplied to each of the control circuit 403, the oscillation circuit 302, the modulation circuit 303, the demodulation circuit 304, the logic circuit 305, the AD converter circuit 306, the sensor circuit 307, and the memory circuit 308.

A charging portion 406 includes at least the charging circuit 310, the battery 311, and the stabilizing power source circuit 312, and controls charging and electric power supply. In addition, the charging portion 406 preferably includes a control circuit for preventing the battery 311 from being overcharged.

Then, current is applied to the heat generating element 410 through the control circuit 403 including a limiter, so that heat generation is started. The control circuit 403 controls the heat generating element 410 so as to prevent the heat generating element 410 from abruptly generating heat when heavy current flows from any cause.

Figure 10B:
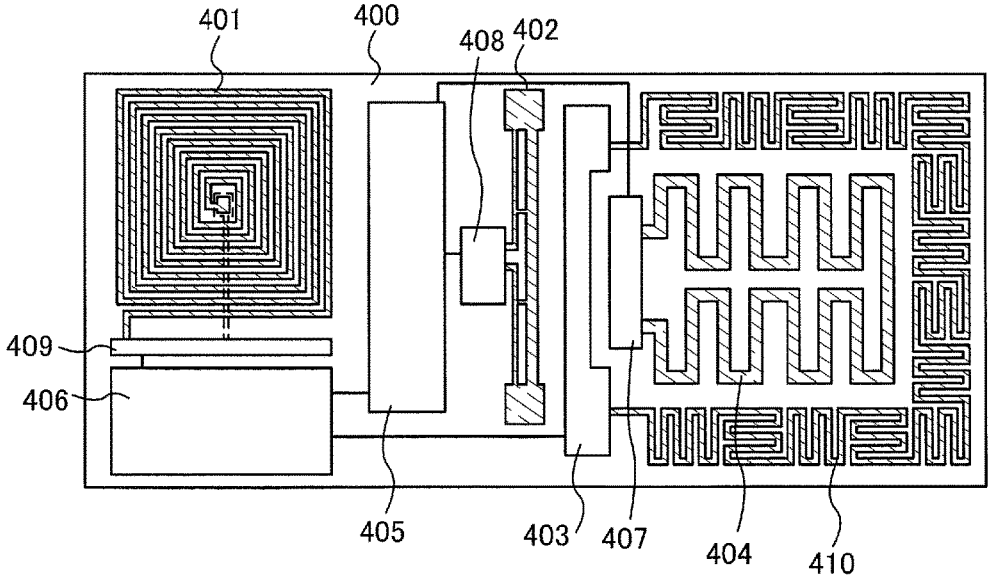

Moreover, the arrangement of the first and second antennas, and a relation of arrangement of the heat generating element 410, the temperature sensor portion 404, and the like are shown in FIG. 10B.

In this embodiment mode, the temperature sensor portion 404 is provided near the heat generating element 410 and the temperature sensor portion 404 measures a change in temperature near the heat generating element 410. When the semiconductor device 400 is in contact with human skin, by measuring not the body temperature of human but the temperature near the heat generating element 410, low temperature burns can be prevented. In order to accurately measure the body temperature of human or the surface temperature of human skin, an element or a structure have to be further added, whereby the number of the steps greatly increases. In addition, electric power is further required for measuring the surface temperature of skin. Moreover, when heating is excessive, to stop heating after measuring the surface temperature of the skin is too late and, accordingly, low temperature burns are caused.

Moreover, by arranging the heat generating element 410 and the temperature sensor portion 404 close to each other and further covering them with a protective layer having high thermal conductivity, the temperature near the heat generating element 410 can be measured accurately. In this invention, a distance between the temperature sensor portion 404 and the heat generating element 410 is shorter than a distance between a surface to be in contact with skin and the heat generating element 410. Accordingly, in the case where the semiconductor device 400 is in contact with human skin, a heat transmission buffering layer is provided on the outer surface of the semiconductor device 400, which is to be in contact with the skin. By providing the heat transmission buffering layer, the distance between the temperature sensor portion 404 and the heat generating element 410 is shorter than the distance between the surface to be in contact with the skin and the heat generating element 410, so that a temperature rise is detected instantaneously and low temperature burns can be prevented. Moreover, when the heat generating element 410 generates heat, the heat transmission buffering layer can prevent the outer surface of the semiconductor device 400, which is to be in contact with the skin, from being locally heated.

The resistance value of the temperature sensor portion 404 varies depending on a temperature rise in the heat generating element 410. In this embodiment mode, a metal resistor having a serpentine pattern is used as the temperature sensor portion 404. The temperature sensor portion 404 is not limited to the meal resistor, and a thin film of a metal such as Au, Ag, Pt, Ni, or Cu, a semiconductor material, or a thermistor formed of a ceramics or the like with a spinel structure containing CoO—NiO—MnO as its main components can be used as the resistor of the temperature sensor portion if the temperature sensor portion 404 serves as a sensor. The sensor circuit 407 converts a variation in the resistance value into an electric signal.

Signals for communication with an external device are transmitted through carrier (carrier wave) modulation. Therefore, in the semiconductor device 400, the modulated signal is necessary to be demodulated. Examples of the carrier frequency include, but not limited to, 125 kHz, 13.56 MHz, 950 MHz, and the like. In addition, examples of a modulation method include, but not limited to, amplitude modulation, frequency modulation, phase modulation, and the like.

A signal input to the second antenna 402 is demodulated in the demodulation circuit 304. The demodulated signal is subjected to operation in the logic circuit 305. When the input signal is an encoded signal, it is decoded in the logic circuit 305. For example, when the signal from the external transmitter has been encoded with modified Miller codes, NRZ-L codes, or the like, the encoded signal is decoded in the logic circuit 305. The decoded data is transmitted to the AD converter circuit 306 and the sensor circuit 407, whereby the AD converter circuit 306 and the sensor circuit 407 are operated.

By the operation of the sensor circuit 407, the semiconductor device 400 can detect temperature information. Here, the temperature information is a resistance value obtained from the temperature portion 404; however, the temperature information is not limited thereto. The sensor circuit 407 has a function of converting such temperature information into an electric signal. The output of the sensor circuit 407 is converted into a digital signal by the AD converter circuit 306. The output signal of the AD converter circuit 306 is subjected to operation in the logic circuit 305. The signal is encoded by the logic circuit 305 when necessary. The output of the logic circuit 305 is modulated by the modulation circuit 303 and then radiated as radio waves from the second antenna 402. The modulation circuit 303 performs modulation by mixing the output of the oscillation circuit 302 and the output of the logic circuit 305.

The radiated radio waves are received by a reception device, and a transmission device continues transmitting the radio waves to the first antenna 401 when the temperature information obtained is within a predetermined temperature range. In addition, when the temperature information obtained is beyond the temperature range, the transmission device stops transmitting the radio waves to the first antenna 401. In this embodiment mode, since an example in which current is applied to the heat generating element 410 through the charging portion 406 is shown, the heat generating element 410 is heated until the charging portion runs out of charge even if transmission of the radio waves to the first antenna 401 is stopped. Therefore, a switch that stops the current application to the heat generating element 410 when the transmission of the radio waves is stopped is preferably provided. Further, preferably, a Peltier device that cools the heat generating element 410 until the charging portion runs out of charge after the current application to the heat generating element 410 is stopped is separately provided near the heat generating element and made to operate. In this embodiment mode, although an example is shown in which current is applied to the heat generating element 410 through the charging portion 406, this invention is not limited thereto.

The memory circuit 308 is used for storing sensed temperature information and is preferably a nonvolatile memory, but this invention is not limited to this. By storing the sensed temperature information, transmission is stopped when the temperature does not change and remains the same so that current consumption can be suppressed. In addition, the memory circuit 308 can function in a manner similar to a nonvolatile memory as long as a power supply is secured. The memory circuit 308 may be an SRAM, a DRAM, a flash memory, an EEPROM, an FeRAM, or the like.

Figure 11A:
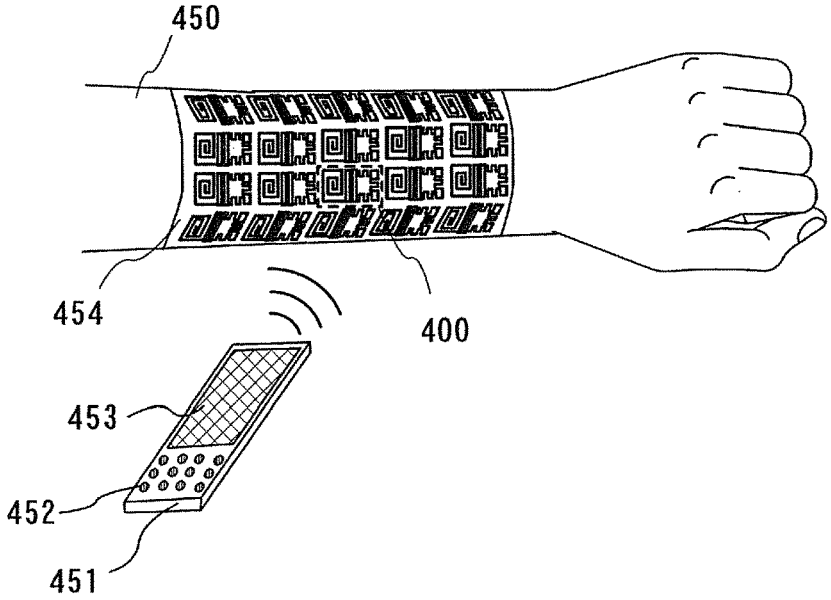
FIG. 11A is a perspective view of a sheet of this invention, which is applied to a supporter

An example of a supporter in which an arm of human is heated by using a plurality of semiconductor devices 400 is shown in FIG. 11A.

A flexible sheet 454 including the plurality of semiconductor devices 400 is provided in contact with a curved surface of an arm 450 of human. Electric power is supplied to the plurality of semiconductor device 400 through radio waves transmitted from a transmission device 451. Heat generating circuits mounted to the respective semiconductor devices 400 generate heat by using the supplied electric power. Moreover, in order to prevent low temperature burns on the surface of the arm 450 of human which is in contact with the sheet 454, the sheet 454 is automatically controlled by a control circuit provided in the semiconductor device 400 and the transmission device 451.

The temperature sensor portion measures a change in the temperature of the heat generating circuit, and the measured temperature information is converted into an electric signal in the sensor circuit. Then, data based on the electric signal is transmitted from the semiconductor device 400 to the transmission device 451. The temperature of the heat generating circuit is always measured and the temperature information is transmitted if there is a change in the temperature. The transmission device 451 judges whether the transmitted data is within a predetermined temperature range or not, and selects transmission or stop of transmission of radio waves.

The transmission device 451 includes a display portion 453 and operation switches 452. A user can control temperature management of the semiconductor device 400. By adjusting an interval between transmissions of radio signals from the transmission device 451, the slope of a curve showing a temperature rise of the heat generating circuit can be adjusted. Further, a timer function for preventing low temperature burns is preferably provided for the transmission device 451.

In addition, serial number is assigned to each of the semiconductor devices 400 and the memory circuit stores the number, whereby the serial number of the semiconductor device 400 can be identified, so that the heat generating circuit in each of the semiconductor devices 400 can be adjusted. In that case, in identifying the serial number, a signal having different frequency from that of the radio signal for power source supply is employed and an antenna which is different from an antenna for receiving the radio signal for power source supply receives the signal. Since the tendency of the temperature rise in human body varies by region depending on the thickness of fat beneath the skin, position of blood vessels, and the like, it is desirable that temperature be finely adjusted.

Since the semiconductor device of this invention includes the control circuit and the like in addition to the heat generating circuit, temperature can be automatically controlled finely. In addition, the plane area of the semiconductor device 400 can be reduced. Further, the plurality of semiconductor devices 400 can be arranged in a tiled pattern so that the temperature of each of the semiconductor devices 400 can be adjusted finely. By reducing the plane area of the semiconductor device 400 and arranging the plurality of semiconductor devices 400 in a tiled pattern, bending of the semiconductor device 400 itself is eased up and portions between the semiconductor devices 400 are bent so that a sheet having high resistance to bending and a heat generating function can be obtained. Alternatively, a supporter having a heat generating function which does not disturb the movement of the arm 450 can be provided by using a stretchy material for the sheet 454, reducing the plane area of the semiconductor device 400, arranging the plurality of semiconductor devices 400 in a tiled pattern, and stretching the portions between the semiconductor devices 400.

Moreover, by reducing the thickness of the protective layer which covers the heat generating circuit and the thickness of the flexible base material to as thin as 20 μm or less, a distance between the heat generating circuit and skin can be shortened so that the skin can be quickly heated.

Moreover, although in FIG. 11A, an example in which the circuit such as the antenna can be seen by eyes is shown, the circuit such as the antenna can be made obscure by selecting a light-shielding material for the sheet 454. In addition, by using a thin film transistor as the circuit for the semiconductor device 400, a sheet having hardly any unevenness on its surface can be realized. As described in Embodiment Mode 3, the semiconductor device 400 can be covered with a material that does not give uncomfortableness to the skin, such as paper. In addition, since the control circuit is provided in the sheet 454, there are no concerns about fire and thus the sheet 454 can be used safely.

Although the arm is illustrated as an example here, a semiconductor device of a supporter type which covers part of a body such as a neck, a shoulder, a waist, a foot, or the like can also be provided.

Figure 11B:
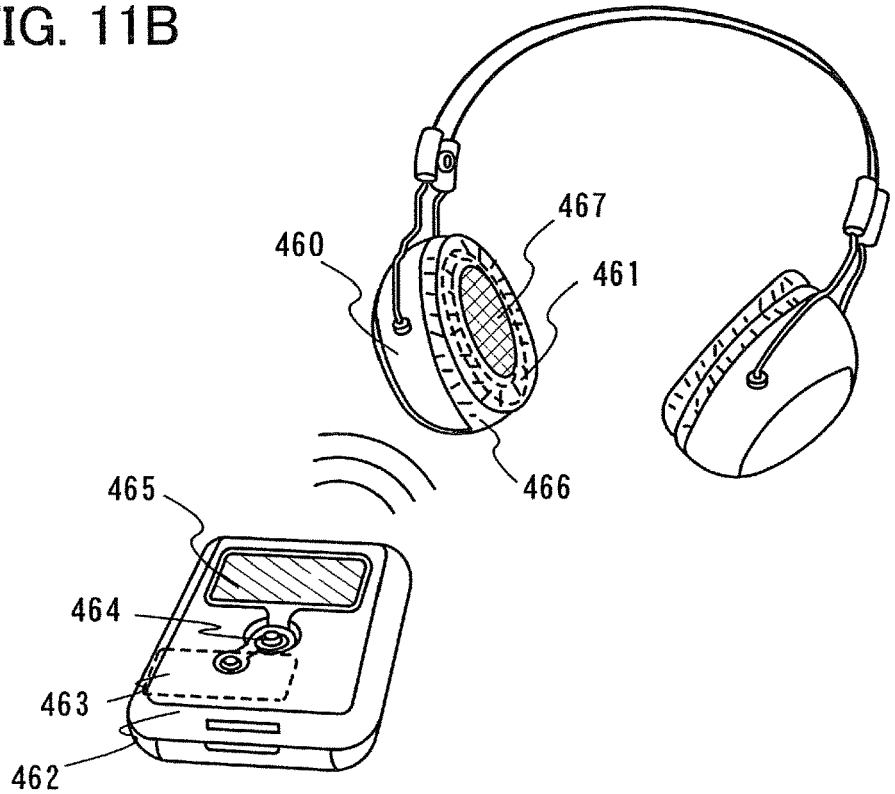
FIG. 11B is a perspective view of a sheet of this invention, which is applied to headphones.

Moreover, FIG. 11B shows an example in which the semiconductor device is applied to ear pads that cover ears, that is, headphones 460 here. In FIG. 11B, a sponge 466 is provided so as to cover a ring-shaped sheet 461 shown by a dashed line around an exposed speaker portion 467. Although the sponges 466 are in contact with ears, both ears are heated by heat generating circuits mounted on the sheets 461 through the sponges 466. Since the sheets 461 are not connected to the headphones 460 through electric wirings, the sheets 461 can be detached from the headphones 460 and changed. Further, since the sheets 461 are thin, the weight of the headphones 460 hardly changes.

Further, the headphones 460 each include a reception circuit that receives radio signals transmitted from an audio player 462, a memory circuit that stores music data received, and a circuit that drives a speaker by sequentially reading out the music data from the memory circuit.

The headphones 460 also each includes a battery and a circuit that transmits radio signals for electric power supply used for heating the heat generating circuit mounted on the sheet 461.

The audio player 462 includes a circuit that wirelessly transmits music data to the headphones 460, a display portion 465, operation keys 464, a storage portion 463, and a secondary battery.

Moreover, besides music data, the audio player 462 can also transmit radio signals for controlling the heat generating circuits mounted on the sheets 461.

The audio player 462 can function as a main transmission device, and the headphones 460 can function as sub-transmission circuits. Radio waves transmitted from the audio player 462 are received by the headphones 460, transmitted by the headphones 460 to the sheets 461, and then received by the sheets 461. In this manner, radio waves can get around so as not to be absorbed into a body, whereby both ears can be heated.

In this manner, by providing the transmission circuit that can wirelessly control the sheet having a heat generating function for a mobile device that transmits radio signals, the sheet having a heat generating function can be used with the use of a mobile device (a mobile phone or the like) that is always carried. In the case where the sheet having a heat generating function is applied to a mobile phone, telephone call is possible by separately providing a microphone to the headphones 460.

Such headphones 460 are used for work in cold climates, work on a ship, climbing mountains, winter sports, jogging during winter, or the like.

Alternatively, by providing the semiconductor device of this invention to a hat, a head region can be heated by electric power supply from the transmission device. In addition, the semiconductor device of this invention can also be used for heating a face as a facemask for beauty treatment. Further, by placing the semiconductor device of this invention around eyes and supplying electric power from the transmission device to heat the eyes, blood circulation around the eyes is promoted in order to relieve the tired eyes. In this manner, even when the semiconductor device of this invention is used for heating a face, temperature can be finely adjusted for each region, which is useful. Moreover, since radio waves can be changed into heat and absorbed, an adverse effect of the radio waves emitted from any cause on human health can be suppressed. In specific, a head region can be protected from unnecessary radio waves by using the semiconductor device of this invention.

This embodiment mode can be freely combined with any one of Embodiment Modes 1 to 3.

Embodiment Mode 5

In this embodiment mode, a specific example of a sheet having a heat generating function that can generate heat even if water droplet attaches will be described.

After exposure to rain or snow in the mountains or getting out from the water at the time of bathing in the sea, heat is drawn from skin by vaporization of water on the skin. In a conventional manner, water is wiped off with a towel which absorbs water or a thermal sheet formed of a heat insulating material has been used.

Figure 8C:
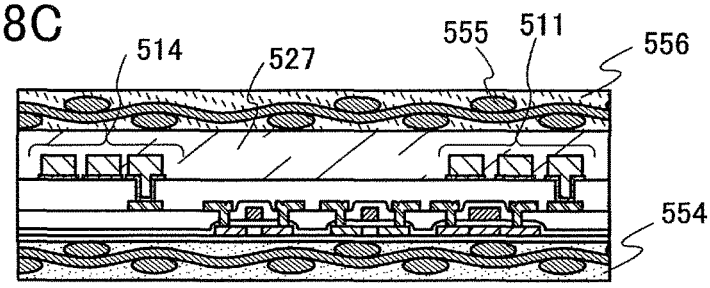
Figure 9A:
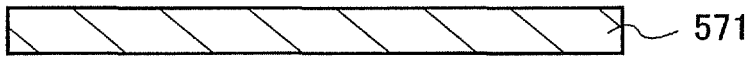
FIGS. 9A to 9D are cross-sectional views illustrating a manufacturing process of a sheet in this invention.
Figure 9B:
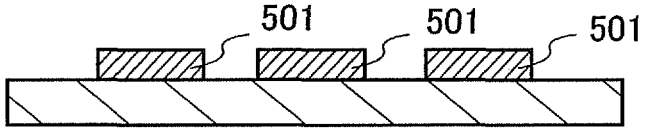
Figure 9C:
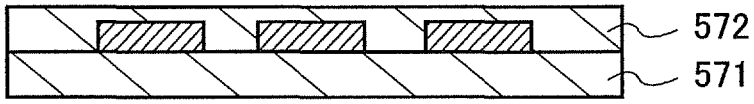
Figure 9D:
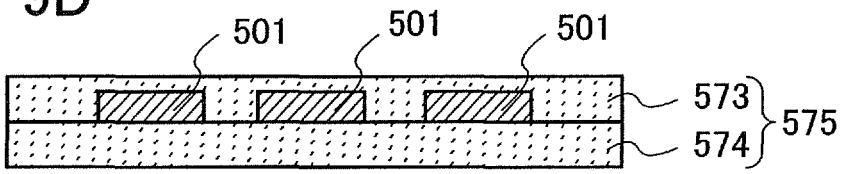

Water repellent finish is provided to a top surface or a back surface of the sheet having a heat generating function shown in Embodiment Mode 1, and the sheet can generate heat by using electric power supply through radio signals from the transmission device. Moreover, even if the water repellent finish is not provided, a material having a water repellent surface can be used for the sheet. In specific, a high-strength fiber described in Embodiment Mode 3 with reference to FIG. 8C is preferably used as the material of the sheet. In addition, it is preferable that water be prevented from entering by surrounding the top and bottom surfaces and side surfaces of the sheet with a base material film as shown in FIG. 7 in Embodiment Mode 3. Even when the sheet having a heat generating function is used in hot and humid conditions because the sheet generates heat and water attaches to the sheet, the sheet can operate without any problem by water repelling finish or Embodiment Mode 3.

Moreover, since the sheet having a heat generating function of this invention includes a circuit for controlling the temperature of a heat generating circuit and can be provided with a temperature sensor, low temperature burns can be prevented and there are no concerns about fire. An electrode and a plug of the sheet having a heat generating function of this invention are not exposed so that leakage or short circuit is not caused even if the sheet gets wet.

In the case of using a mobile transmission device, part of a body can be heated by using the sheet having a heat generating function of this invention at any place including a beach, a ship, a mountain, or the like so that the sheet can be used for a life preserver.

Moreover, part of a human body can be wrapped with a large flexible sheet measuring more than 1 m on one side, which is provided with a plurality of heat generating circuits and a plurality of circuits that receives electric power without contact. Further, the flexible sheet is light and can be folded to be carried.

As a transmission method of the radio signal from the transmission device, an electromagnetic coupling method or an electromagnetic induction method (for example, a band of 135 kHz or less, or a 13.56 MHz band) is employed. A microwave method (for example, a UHF band (a band of 860 to 960 MHz), a 2.45 GHz band, or the like) can also be used for heating so far forth as some drops of water adhere.

However, since microwaves are easily absorbed into water, the electromagnetic coupling method or the electromagnetic induction method is employed for goods whose sheet is to be completely soaked in water. As a frequency for a transmission device that transmits radio waves in the water, 133 kHz is employed. For diving, the sheet having a heat generating function is provided inside of a wet suit and the transmission device is carried as one of diving apparatuses such as an air bottle, so that skin can be heated by heat generation of the sheet having a heat generating function by receiving electric power from the transmission device without contact in the water. Since the electric power can be supplied from the transmission device without contact, the sheet can be set up by just fixing it inside the wet suit without making holes or the like on the wet suit for wirings. Moreover, since the sheet having a heat generating function is a flexible sheet which is thin and light, the sheet having a heat generating function is obscure and does not disturb movement even if it is provided inside the wet suit.

By using the sheet having a heat generating function, part of a body can be heated even in the water so that exhaustion in the sea during winter can be suppressed and bottom time can be prolonged.

Moreover, for ocean sports such as surfing, without being limited to diving, a wet suit or a rash guard is used. Since heat is kept by just warming water contained in the wet suit or the like by the body temperature of a user, the user is heavily exhausted especially in a cloudy day during winter and the frequency of getting ashore is increased.

In this invention, when the user carries the transmission device, the sheet having a heat generating function provided inside the wet suit or the rash guard of the user can be heated at will. By using the sheet having a heat generating function of this invention, exhaustion of the user is suppressed and the user can enjoy ocean sports for a long time even in a cloudy day during winter.

Further, for work accompanied with exposure to cold water outdoors or snow shoveling during winter, thick rubber gloves are used for preventing hands from getting chilled; however, the hands get chilled over time. Moreover, in the case of washing clothes or dishes, thick rubber gloves are used for preventing hands from getting chilled but the result is similar.

Further, in the case of an experiment using a cold chemical, nitrogen blow using liquid nitrogen, or the like, fingers especially get chilled.

Furthermore, in the medical field, when an organ stored in a preservative solution of low temperature for organ transport is taken out, or when cardiac surgery is performed after a heart is cooled down with iced water, the hands of worker are cooled down, whereby movement of fingers becomes slow and there are concerns that it is difficult to perform fine work.

Figure 12:
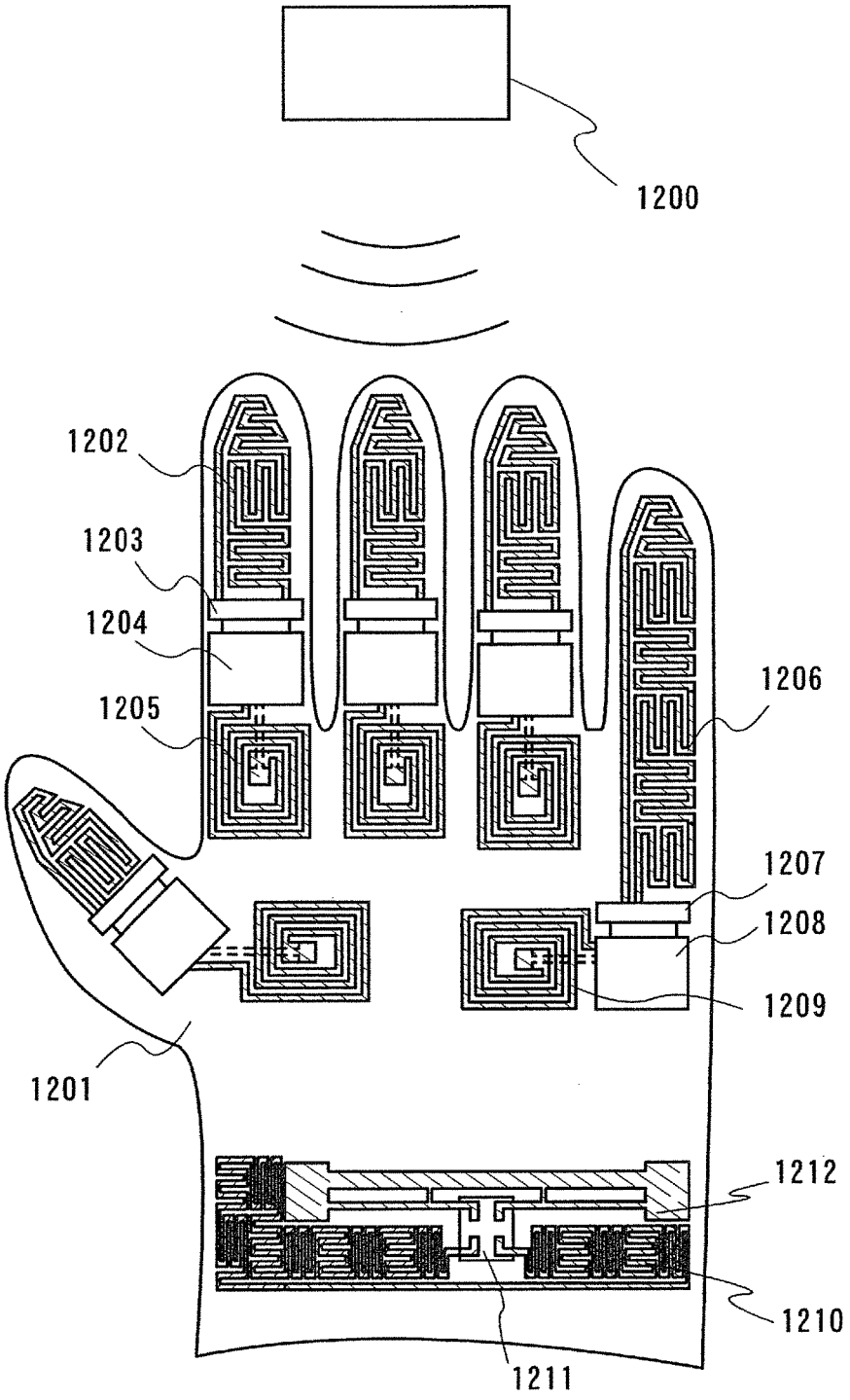
FIG. 12 is a top view of a sheet of this invention, which is applied to a glove.

In order to solve the above-described problems, this embodiment mode will show a glove formed of a resin in which a plurality of heat generating circuits is provided using FIG. 12. FIG. 12 illustrates a glove for a left hand.

A glove 1201 formed of a resin includes the plurality of heat generating circuits and antennas. In a thumb and a little finger, the heat generating circuit and the antenna have different arrangement from that in the other fingers. Heating can be performed by receiving radio waves from a transmission device 1200 by the antenna and applying electric power obtained to a heat generating element.

A heat generating element 1202 provided to an index finger is electrically connected to a control circuit 1203, and a signal processing circuit 1204 including a reception control circuit and a power source circuit is electrically connected to a coiled antenna 1205. Further, the signal processing circuit 1204 is electrically connected to the control circuit 1203. The control circuit 1203 controls the temperature of the heat generating element 1202 and prevents low temperature burns. In this embodiment mode, the signal processing circuit 1204 and the control circuit 1203 are provided to a portion between the second joint and the third joint, which does not relatively bend so much to prevent the circuit from being damaged due to bending of the finger.

Moreover, the heat generating element 1202 which is part of the heat generating circuit is preferably formed of a flexible material such as an epoxy resin containing silver. By using a flexible material for the heat generating element 1202, movement of the finger is not disturbed.

A heat generating element 1206 provided to the little finger is electrically connected to a control circuit 1207, and a signal processing circuit 1208 including a reception control circuit and a power source circuit is electrically connected to a coiled antenna 1209. Further, the signal processing circuit 1208 is electrically connected to the control circuit 1207. In this embodiment mode, the signal processing circuit 1208 and the control circuit 1207 are provided to the palm, which does not relatively bend so much to prevent the circuit from being damaged due to bending of the finger.

In FIG. 12, the antennas that heat five fingers are coiled antennas, and an electromagnetic coupling method or an electromagnetic induction method (for example, a band of 135 kHz or less, or 13.56 MHz) is employed.

Further, an antenna for heating a wrist is a dipole antenna, and a radio wave method is employed. In this embodiment mode, the transmission device 1200 generates radio waves for the both antennas. In the case where the radio wave method is employed, when the glove 1201 is put on a left hand while working, the transmission device is provided where the radio wave is not absorbed into a body. In this embodiment mode, although an example is shown in which the transmission methods using radio signals having different frequencies are employed, this invention is not limited thereto. A transmission method using a radio signal having a single frequency may also be employed. Alternatively, a plurality of transmission devices corresponding to respective frequencies that are different from each other may be provided.

Further, the heat generating circuit can be provided not only to the palm side but also the back side of the hand.

As a material of the glove 1201 formed of a resin, polyvinylchloride, polyethylene, or the like is used. A periphery of a circuit portion such as the signal processing circuit may be covered with the resin which forms the glove 1201. Moreover, the circuit portion such as the signal processing circuit may be provided to an inner surface of the glove, and a protective layer that covers the circuit portion may be formed. By using a stretchy material such as natural rubber, as the material of the glove 1201 formed of the resin, the glove can fit the hand. Moreover, the semiconductor device can be mass-produced by the manufacturing method described in Embodiment Mode 3 and the heat generating circuit can be formed at a low cost; therefore, the glove can also be disposable. The glove is especially useful in housework, the medical field, or the like where hygiene is important.

Further, in the case of an experiment using a cold chemical, nitrile butadiene rubber (NBR) which is resistant to chemicals is preferably used as the material of the glove 1201 formed of the resin.

Further, the sheet having a heat generating function may be provided inside a thick rubber glove. Alternatively, after a small sheet having a heat generating function is attached to part of a finger, a glove formed of the resin, a thick rubber glove, or the like may be put on.

According to this invention, work accompanied with exposure to cold water, snow shoveling, or the like outdoors during winter may be conducted while fingers are warmed by putting the glove shown in FIG. 12 on a hand, carrying the portable transmission device, and generating heat with the heat generating element through radio signal transmission; therefore, the work can be conducted for a long time.

Further, since the glove 1201 formed of the resin, which is shown in FIG. 12 is thin, a glove for protection against cold can be additionally put on a hand with the glove 1201 on. Electric power can be supplied without contact even if the gloves are layered so that working while warming the hand is possible below the freezing point.

In addition, for housework during winter, such as washing dishes, the glove shown in FIG. 12 is put on a hand and the transmission device is provided in a kitchen. Accordingly, dishes can be washed while fingers are warmed by using radio waves transmitted from the transmission device.

Further, in the case of an experiment using a cold chemical or nitrogen blow using liquid nitrogen, the glove shown in FIG. 12 is put on a hand and the transmission device is provided in a draft chamber or a clean room. Accordingly, the experiment can be conducted while fingers are warmed by using radio waves transmitted from the transmission device. Since only the hand can be warmed by using the glove shown in FIG. 12, a worker can comfortably work on the experiment without changing the temperature inside of the draft chamber or the clean room.

Moreover, in the medical field, a material having high thermal conductivity is used for a surface of the glove shown in FIG. 12, which is to be in contact with skin, and a heat insulating material having low thermal conductivity is used for an outer surface of the glove shown in FIG. 12, whereby only a hand is preferably heated without changing the temperature of the outer surface. Alternatively, a material layer of the surface to be in contact with the skin can be thinned and a material layer of the outer surface can be thickened without using different materials.

An organ can be taken out while fingers are warmed by the glove, which is shown in FIG. 12, put on the hand by using radio waves transmitted from the portable transmission device or the transmission device fixed on a floor while heat is hardly conducted to the organ stored in a preservative solution of low temperature. Further, when cardiac surgery is performed after a heart is cooled down by iced water, fine work can be performed while fingers are warmed by the glove, which is shown in FIG. 12, put on the hand by using radio waves transmitted from the portable transmission device or the transmission device fixed on a floor.

Further, partial heating is possible by providing the small sheet having a heat generating function to a diseased part and using radio signal transmitted from the portable transmission device. For example, in the case of surgery in which arteries of a thigh is blocked, there are concerns about causing necrosis of body cells in a toe because blood does not flow to the toe and temperature of the toe decreases. Start of the necrosis can be postponed by cooling the thigh and stopping bleeding from the thigh, providing a plurality of small sheets having a heat generating function in contact with a calf or the toe, and warming the calf or the toe with heat generation through radio signals from the transmission device. In this manner, in the medical field, to selectively heat part of body without contact is useful.

However, since a frequency band of radio waves used in the medical field is limited to an ISM frequency band and other medical instruments influenced by the radio waves are often used, it is needless to say that caution is demanded to avoid malfunction of other medical instruments due to radio signals from the transmission device.

This embodiment mode can be freely combined with any one of Embodiment Modes 1 to 4. For example, the temperature of the heat generating circuit may be finely adjusted by mounting a temperature sensor, or a battery may be mounted. By mounting the battery, even when radio waves are blocked due to movement of part of a body, heat can be continuously generated in the heat generating circuit.

Embodiment Mode 6

The sheet having a heat generating function can be used for warming not only a surface of a human body but also other objects. A practical application to a container is shown in FIGS. 13A and 13B.

Figure 13A:
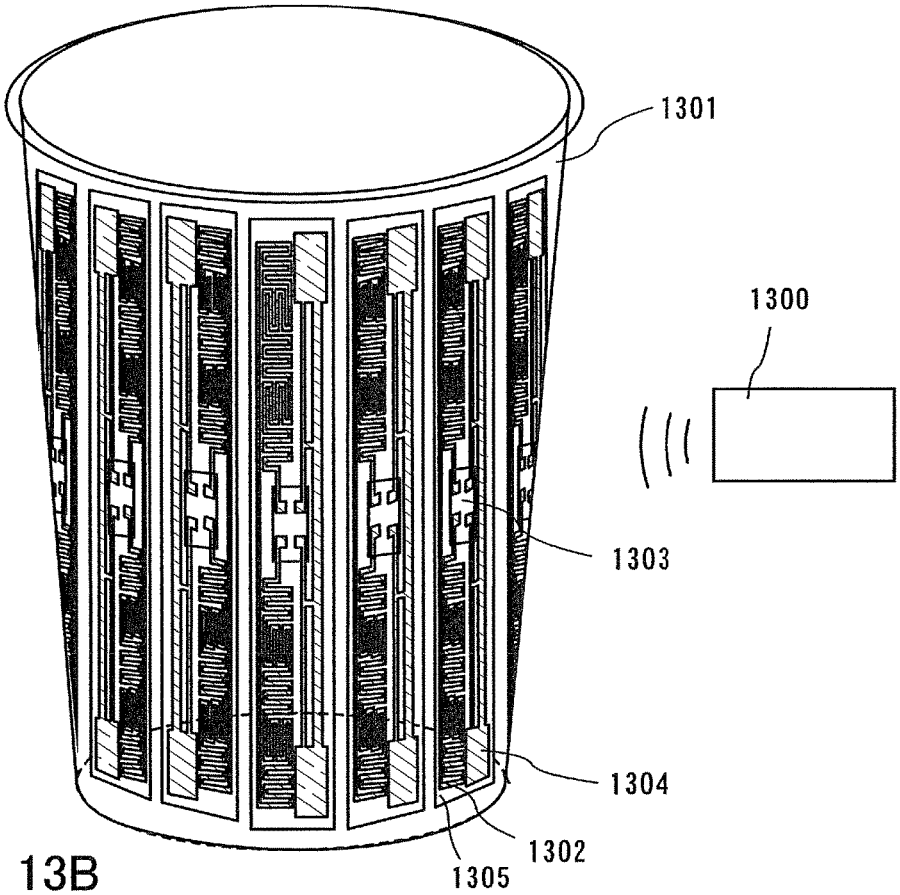
FIG. 13A is a perspective view of a sheet of this invention, which is applied to a paper cup
Figure 13B:
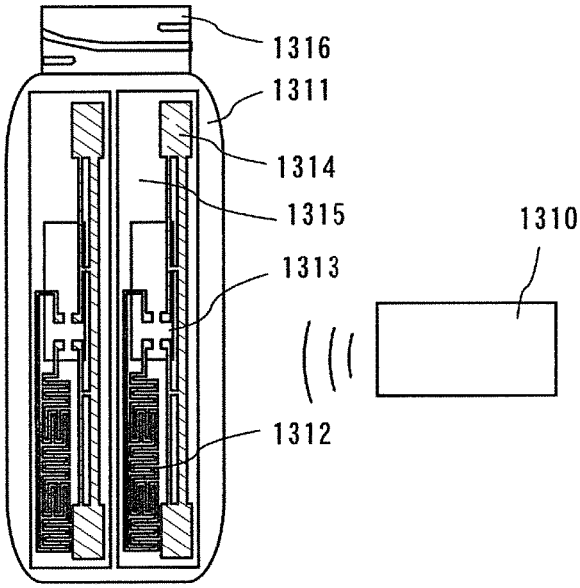
FIG. 13B is a perspective view of a sheet of this invention, which is applied to a container.

A sheet 1305 having a heat generating function is embedded in paper through steps shown in FIGS. 9A to 9D described in Embodiment Mode 3, and a paper cup 1301 shown in FIG. 13A is assembled using the paper. A plurality of sheets 1305 having a heat generating function is provided so as to surround the side surface of the paper cup 1301. Note that in FIG. 13A, the sheets 1305 having a heat generating function are shown for making an arrangement of the sheets 1305 clear. However, the sheets 1305 having a heat generating function are hard to be seen because they are actually embedded in the paper. Further, since the sheets 1305 having a heat generating function are thin, the side surface of the paper cup 1301 has hardly any unevenness and the existence of the sheets 1305 having a heat generating function is hard to be seen.

The sheet 1305 having a heat generating function is formed of a flexible plastic or fiber. Further, an antenna 1304, a circuit portion 1303, and a heat generating element 1302 are formed over the sheet 1305 having a heat generating function. These elements and circuits included in the sheet 1305 having a heat generating function are described in Embodiment Mode 1 or 2, and detailed descriptions thereof are omitted in this embodiment mode. The antenna 1304 is a dipole antenna and is provided as shown in FIG. 13A so that the antenna is prevented from being largely bent in longitudinal direction.

Radio waves from a transmission device 1300 are transmitted to the antennas 1304 by a microwave method. When a microwave is emitted from the transmission device 1300 to a cup filled with drink, it is hard for the antennas on an opposite side to receive the microwave because the microwave is absorbed into water of drink. In order to have the antennas on the opposite side receive a radio signal, a plurality of transmission devices 1300 is used, the transmission device 1300 is moved, or a means of making the radio wave get around is provided for heating.

For example, when the antenna 1304 receives the microwave emitted from the transmission device 1300 to the paper cup 1301 filled with cold water and electric power is obtained in the circuit portion 1303, the cold water can be heated by application of the electric power to the heat generating element 1302.

Since the circuit portion 1303 includes a circuit for controlling the temperature of the heat generating element 1302, the temperature is set to be within a range which does not cause low temperature burns when the paper cup 1301 is held by a hand.

Further, when the antenna 1304 receives the microwave emitted from the transmission device 1300 to the paper cup 1301 filled with hot coffee and electric power is obtained in the circuit portion 1303, the temperature of the coffee can be hard to decline by application of the electric power to the heat generating element 1302. If the paper cup 1301 is filled with hot drink, the hot drink is cooled by heat discharge through the side surface and bottom surface of the paper cup; however, by heating the side surface of the paper cup 1301, cooling speed can be reduced.

By carrying a portable transmission device as the transmission device 1300, along with the paper cup 1301, heating can be performed at any place. By adjusting on/off of the transmission device 1300, temperature can be finely adjusted to a temperature a user wants. For example, drink can be kept at an optimal temperature for a long time by the following; the paper cup 1301 filled with hot drink is left for some time to be naturally cooled down; the transmission device 1300 is turned on when the hot drink come to have the optimal temperature the user wants; and the side surface of the paper cup is warmed by using electric power supplied without contact. Since the circuit portion 1303 includes the circuit for controlling the temperature of the heat generating element 1302, burns of a tongue or in a mouth can be prevented.

Here, although the example is shown in which the plurality of sheets are embedded in the paper, the sheet can also be applied to part of a plastic cup. In the case of plastic, the sheet 1305 having a heat generating function can be attached to the outside of the cup by an adhesive or the like. Alternatively, the sheet 1305 having a heat generating function can be embedded inside of the plastic. In this specification, the case where the sheet 1305 having a heat generating function is attached to the outside of the cup by an adhesive or the like is regarded as forming part of the container. Further, if an attaching means is provided to the sheet having a heat generating function obtained in Embodiment Mode 1, a user can attach the sheet having a heat generating function as appropriate to the side surface of a conventional paper cup or a conventional plastic cup.

The sheet having a heat generating function can be applied not only to a cup to be filled with drink but also to various containers such as a container for storing other foods. A microwave oven is fixed and cannot be carried because of its heavy weight. Note that embedding a heat generating sheet into a container or attaching the heat generating sheet to the container and using a portable transmission device for heating means that the container can be heated by a microwave oven at any place. In the case of a microwave oven, there are limitations on the kind of material for the container because a container with aluminum foil, lacquer wares, and the like cannot be used. In addition, contents burst when it is excessively heated in the microwave oven in some cases. However, since the sheet of this invention can partly heat the container, various kinds of containers can be used. In addition, abrupt heating caused when the contents absorb radio waves can be suppressed.

A practical application to a container for nursing a baby is shown in FIG. 13B.

A plastic material that can be sterilized by hot water or the like is used as a container 1311 for nursing. However, if the container is used as a disposable container, a plastic material or paper that cannot be sterilized can be used.

The container 1311 for nursing is provided with a mounting portion 1316 around an opening, which can be provided with a nipple made of silicon rubber for a nursing bottle.

A plurality of sheets 1315 having a heat generating function is fixed on a side surface of the container 1311 for nursing. An antenna 1314, a circuit portion 1313, and a heat generating element 1312 are formed over the sheet 1315 having a heat generating function.

For example, milk can be heated as follows: a microwave is emitted from a transmission device 1310 to the container 1311 filled with cold milk, and the antenna 1314 receives the microwave; electric power is obtained in the circuit portion 1313; and the electric power is applied to the heat generating element 1312.

The temperature of milk to feed a baby may be approximately the same as body temperature, that is, less than 40° C. By using the container 1311 for nursing, milk can be kept at an optimal temperature for a long time. Further, since the circuit portion 1313 includes a circuit for controlling the temperature of the heat generating element 1312, burns of the tongue or in the mouth of the infant can be prevented. Further, the temperature of the heat generating element 1312 is controlled by the circuit portion 1313 so as to keep heating within a range in which the temperature of milk does not come to 40° C. or higher.

In the case of a conventional glass nursing bottle, milk is made of powder milk melted in hot water and a baby is fed with the milk after waiting for the temperature of the milk to come down to body temperature. Since the nursing bottle is made of glass, a hand that holds the nursing bottle is at a risk of getting a low temperature burn while the water is hot. Further, since the temperature outside of the bottle and that of the milk are different, it is hard to know the temperature of the milk; therefore, to check the temperature of the milk, the milk is actually dropped on a nurser's hand for example. However, when one nurser is taking care of a baby, it is hard for the nurser to do that work because the nurser holds the baby on his/her one arm. Further, using hot water or a hot nursing bottle while holding the baby who gets low temperature burns more easily than adults on one arm is dangerous. When the baby bitterly cries and/or moves, the nurser has to wait for the baby to be calmed down by walking while holding the baby because it is hard to feed such baby. While the nurser is waiting for the baby to be calmed down, the milk is cooled down. Once milk is cooled down, the milk is put away to make another one again because the concentration of the milk is changed by addition of hot water.

The cooling speed of plastic is faster than that of glass and it is harder for plastic to keep milk at an optimal temperature than glass. However, by using the sheet 1315 having a heat generating function, milk can be kept at an optimal temperature for a long time.

Further, milk can be prepared in the container 1311 for nursing, kept at room temperature or refrigerated, and heated by the transmission device 1310 when necessary, whereby milk with an optimal temperature can be obtained. By using a portable small transmission device as the transmission device 1310, even when the nurser walks whicle holding the baby on one arm, the other arm can operate the transmission device 1310 to heat the container 1311 for nursing on a desk or the like within a range over which radio waves can be transmitted. Then, the nurser can feed the baby with milk at an optimal temperature.

Further, since an electrode and wiring of the sheet 1315 having a heat generating function are not exposed and are covered with plastic or a protective layer, metal composition or the like does not flow into milk.

Although a microwave method is employed in this embodiment mode, this invention is not limited thereto. Radio waves of other frequencies can also be used.

This embodiment mode can be freely combined with any one of Embodiment Modes 1 to 4. For example, the temperature of the heat generating circuit can be finely adjusted by mounting a temperature sensor, or a battery can be mounted. By mounting the battery, even when radio waves are blocked due to an object that absorbs radio waves, the heat generating circuit can be continuously heated.

Embodiment Mode 7

Although an example is shown in which a heat generating element having a serpentine shape is employed in Embodiment Mode 1, an example will be shown in which a heat generating material is provided between a pair of electrodes in this embodiment mode.

Figure 14A:
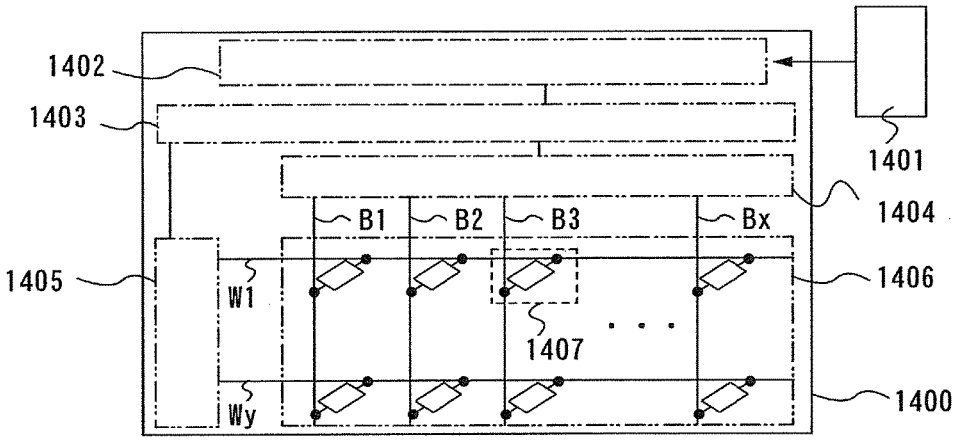
FIG. 14A is a diagram illustrating an equivalent circuit of a sheet of this invention.

As shown in FIG. 14A, first wirings are provided in parallel in row direction and second wirings are provided in parallel in column direction. A heat generating material is provided in a region where a first wiring W1 and a second wiring B1 intersect and the heat generating material is interposed between the first wiring and the second wiring. A region that generates heat, including an element having this structure as a heat generating element is a region where the first wiring and the second wiring intersect. A plurality of heat generating elements is provided for one sheet 1400 having a heat generating function.

When electric power is applied to the heat generating element having a serpentine shape as shown in Embodiment Mode 1, the whole heat generating element is heated. In this embodiment mode, a wiring to which electric power is applied is selected. By applying a voltage to the first wiring or the second wiring, a desired heat generating element 1407 can be driven.

For example, if rapid heating is required, all the heat generating elements 1407 provided for a heat generating circuit 1406 may be driven for heating. If slow heating is required, the number of heat generating elements 1407 that are driven may be increased to sequentially perform heating.

A voltage of the first wiring W1 may be controlled by a first control circuit 1405, and a voltage of the second wiring B1 may be controlled by a second control circuit 1404. Electric power may be supplied to the first control circuit 1405 and the second control circuit 1404 from a power source circuit 1403. A circuit 1402 including an antenna receives radio signals from a transmission device 1401. The circuit 1402 including the antenna is electrically connected to the power source circuit 1403 and receives electric power from the transmission device 1401 without contact.

Figure 14B:
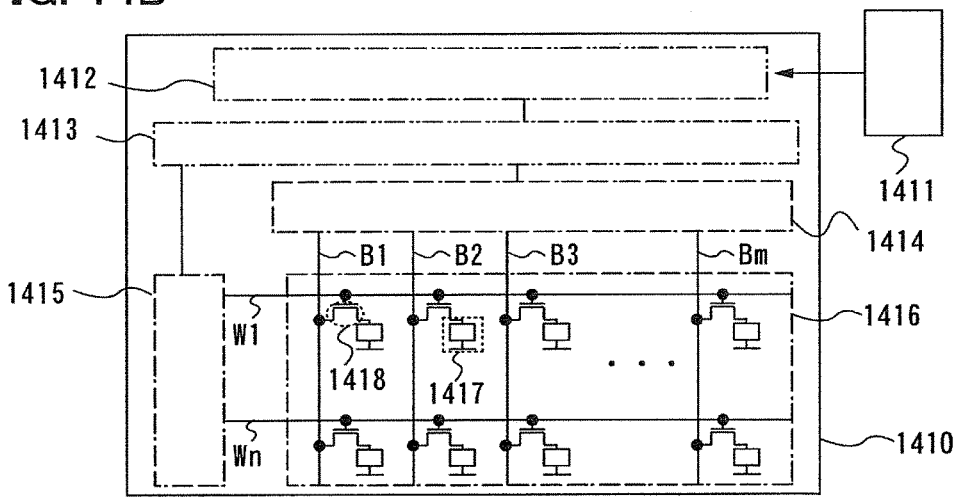
FIG. 14B is a diagram illustrating an equivalent circuit of a sheet of this invention.

In addition, as shown in FIG. 14B, a switching element 1418 can be provided for every heat generating element 1417 in a heat generating circuit 1416. Heat is generated also in the switching element 1418 to generate heat more efficiently. Further, the heat generating circuit having the circuit configuration shown in FIG. 14B can be driven at a voltage lower than a voltage for the heat generating circuit having the circuit configuration shown in FIG. 14A. Amount of heat generation in one sheet 1410 having a heat generating function can be increased by low voltage drive.

The voltage of the first wiring W1 may be controlled by a first control circuit 1415, and the voltage of the second wiring B1 may be controlled by a second control circuit 1414. Electric power may be supplied to the first control circuit 1415 and the second control circuit 1414 from a power source circuit 1413. A circuit 1412 including an antenna receives radio signals from a transmission device 1411. The circuit 1412 including the antenna is electrically connected to the power source circuit 1413 and receives electric power from the transmission device 1411 without contact.

Figure 14C:
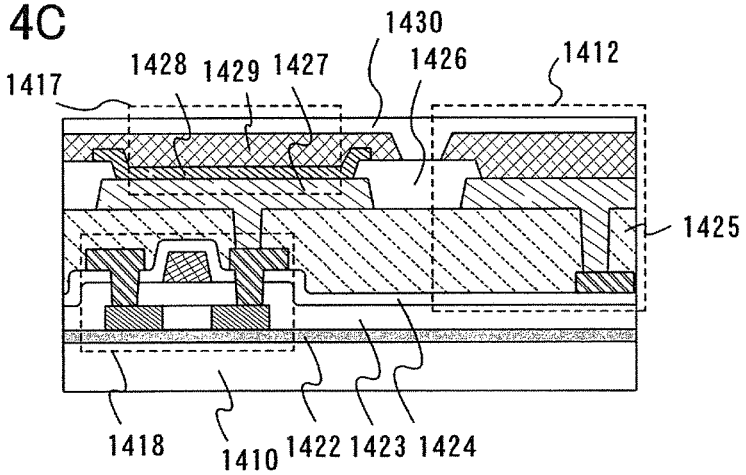
FIG. 14C is a cross-sectional view of a sheet of this invention.

An example of a cross-sectional structure of the heat generating element 1417, the switching element 1418, and the circuit 1412 including the antenna is shown in FIG. 14C.

A first insulating layer 1422 is formed over the sheet 1410 containing plastic or a fibrous body, and the switching element 1418 which is a thin film transistor is provided over the first insulating layer 1422. Note that a second insulating layer 1423 is a gate insulating film and a third insulating layer 1424 is an interlayer insulating film. A fourth insulating layer 1425 is a planarizing insulating film and a contact hole that reaches an electrode of the switching element 1418 is formed in the fourth insulating layer 1425. A first electrode 1427 which is electrically connected to the electrode of the switching element 1418 through the contact hole is provided. A fifth insulating layer 1426 which covers a periphery portion of the first electrode 1427 is provided. Further, a heat generating material layer 1428 is formed so as to be in contact with part of the first electrode 1427, which is not covered with the fifth insulating layer 1426. The heat generating material layer 1428 may have a multi-layer structure. Then a second electrode 1429 is formed over the heat generating material layer 1428. By using the same material as that for the antenna included in the circuit 1412 for the second electrode 1429, the number of steps can be reduced. Moreover, a protective layer 1430 that covers the antenna included in the circuit 1412 and the second electrode 1429 is provided.

As a material for the heat generating material layer 1428, an organic EL material such as PEDOT (polyethylenedioxythiophene) or $Alq_3$ (tris(8-quinolinato)aluminium) can be used. The organic EL material interposed between the pair of electrodes can emit light by voltage application and also generate heat by heat inactivation. Accordingly, when a transparent conductive film is used for one of the first electrode 1427 and the second electrode 1429 and a light-transmitting material is used as a material for the sheet 1410 and each insulating layer, visible light can be emitted to the outside of the sheet, whereby a user can see if the heat generating element 1417 is supplied with a current and generates heat. Since a breakdown can be checked with eyes, the sheet can be exchanged to a new one.

Although an example is shown in which the heat generating element 1417 includes the first electrode 1427, the heat generating material layer 1428, and the second electrode 1429 in this embodiment mode, there are no limitations on the structure as long as an adequate amount of heat generation can be obtained.

As compared to the heat generating element having a serpentine shape shown in Embodiment Mode 1, the plane area of the heat generating circuit 1416 can be reduced so that the size of the sheet 1410 can be small.

This embodiment mode can be freely combined with any one of Embodiment Modes 1 to 6. For example, the temperature of the heat generating circuit can be finely adjusted by mounting a temperature sensor.

Embodiment Mode 8

In this embodiment mode, the sheets having a heat generating function obtained in Embodiment Mode 1 are fixed in a tiled pattern on one large flexible sheet and the large flexible sheet is placed in various places to be utilized.

For example, the large sheet having the heat generation function is provided over a sheet of bedclothes such as a bed and a futon, and electric power is supplied from a transmission device without contact so that the large sheet can be heated. With the use of a control circuit mounted on the large sheet having a heat generating function or the transmission device, even when a physically challenged person due to injury, decrepitude, or the like is kept laid down on the large sheet, heat generation can be automatically adjusted for heating without causing low temperature burns. Likewise, when a newborn baby or an infant whose body temperature regulation is immature is laid down on the large sheet, heat generation can be automatically adjusted for heating without causing low temperature burns.

As a transmission method of radio signals from the transmission device, an electromagnetic coupling method and or an electromagnetic induction method (for example, using a band of 135 kHz or less, or a 13.56 MHz band) is employed. In the case where the electromagnetic induction method is employed, even when a human body is wrapped with the large sheet by being bent, radio waves from the transmission device gets around and a heat generating circuit of a sheet provided to part of the body may be heated. Alternatively, a microwave method (for example, using a UHF band (a band of 860 to 960 MHz), a 2.45 GHz band, or the like) can be used. In the case where the microwave method is employed, since the radio waves are likely to be absorbed into the human body, the transmission device is provided under the large sheet. In addition, in order to make the radio waves get around, a sub-transmission device may be provided.

Figure 15A:
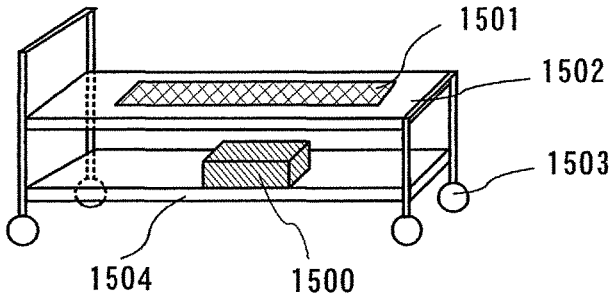
FIG. 15A is a perspective view of a sheet of this invention, which is applied to a bed

In medical field, the frequency band of radio waves used is limited to an ISM frequency band. In FIG. 15A, an example is shown in which a large sheet 1501 having a heat generating function is used as a sheet of a bed 1502 that can be moved.

The bed 1502 that can be moved shown in FIG. 15A includes wheels 1503 and a shelf 1504 under the bed on which a person sleeps.

A transmission device 1500 is provided in an area in the shelf 1504 under the bed, where the large sheet 1501 overlaps above. Note that, by mounting a rechargeable battery on the transmission device 1500, radio signals from the transmission device 1500 can be transmitted while the bed 1502 is moved.

In general, operation is conducted after a bed is moved from a hospital room to an operating room. After the operation, the bed is returned to the hospital room. Since body temperature declines during operation with general anesthesia, the body temperature is necessary to be increased when the patient recovers from anesthesia after the operation to prevent an infection. By using the large sheet 1501, the body temperature can be increased when the patient recovers from anesthesia after the operation by heating through the transmission of the radio signals from the transmission device 1500 to prevent an infection. In addition, the patient can be continuously heated while being moved to the hospital room after the operation.

In addition, the transmission device 1500 can function as an antenna by being electrically connected to a framework of the shelf 1504 so that the radio waves can be emitted over a large area.

If the bed 1502 that can be moved is mounted in an ambulance as a folding bed, a patient can be continuously heated while the patient is transported by the ambulance and while the patient is transported into a hospital.

With the use of the control circuit mounted on the large sheet 1501 having a heat generating function, or the transmission device 1500, even when a patient is kept laid down on the large sheet 1501, heat generation can be automatically adjusted for heating without causing low temperature burns. In addition, the large sheet 1501 can be heated during operation so that loss of bodily strength of a patient due to a reduction in the body temperature caused by anesthesia or bleeding can be suppressed.

Figure 15B:
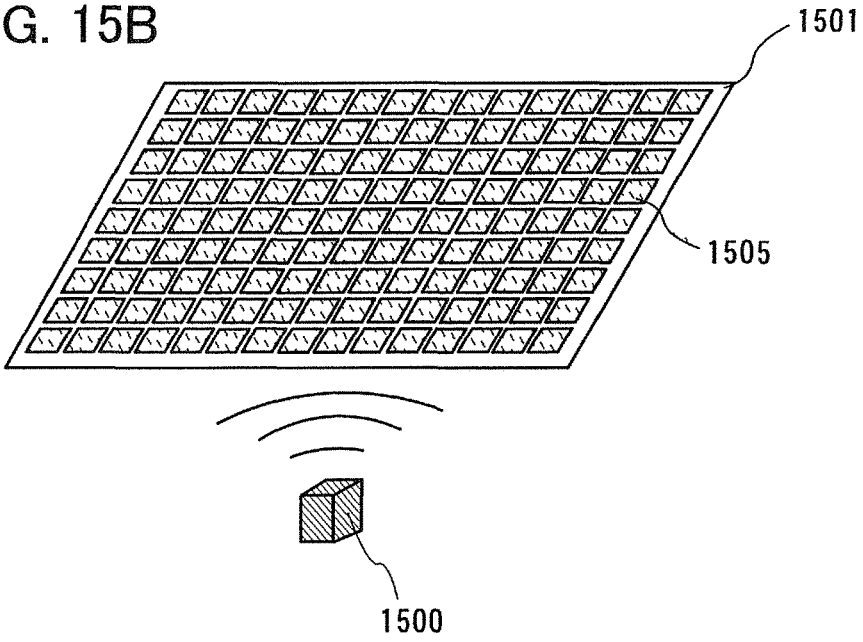
FIG. 15B is a schematic view of a plurality of sheets of this invention, which are provided over a large sheet.

FIG. 15B is an enlarged diagram of the large sheet 1501 having a heat generating function. A plurality of sheets 1505 having a heat generating function obtained in Embodiment Mode 1 is fixed in a tiled pattern on one large flexible sheet 1501. It is preferable that portions which are mainly bent or stretched be part of the large sheet by fixing the plurality of sheets 1505 having a heat generating function in the tiled pattern with a space between the sheets 1505.

Further, when a patient is laid down on the large sheet 1501, the sheet is partly bent or stretched by the weight of the patient. However, if a high-strength fibrous body is used for the sheet 1505 having a heat generating function, pressure is spread over the whole fibrous body and a circuit can be prevented from being partly stretched.

The large sheet 1501 can be used as not only bedclothes but also an electric carpet by providing the large sheet having a heat generating function on a floor. However, in that case, the transmission device is provided under the floor.

The large sheet 1501 can also be used for a chair or a seat. For use, the large sheet 1501 having a heat generating function is just provided in a portion which is in contact with a human buttock. The large sheet 1501 can also be used for seats in a train or car. In that case, the transmission device is provided under the large sheet 1501.

Further, the large sheet 1501 can be used for heating not only human but also a pet and plant. With the use of the control circuit mounted on the large sheet 1501 having a heat generating function, or the transmission device 1500, heat generation can be automatically adjusted for heating without damaging the pet or plant. The trunks of plants that are sensitive to the cold are covered with straw mats during winter. Instead of using the straw mat, the trunk of the plant can be covered with the large sheet 1501 and heated with the use of the transmission device provided within a region over which signals can be transmitted. Specifically in a fruit farm, some fruit trees do not produce fruits in the following harvest if the weather is too cold.

This embodiment mode can be freely combined with any of Embodiment Modes 1 to 4, or Embodiment Mode 7.

According to this invention, the semiconductor device can be mass-produced by using a large glass substrate and a unit price can be low so that the semiconductor device can be used for disposable goods.

This application is based on Japanese Patent Application serial no. 2007-238464 filed with Japan Patent Office on Sep. 13, 2007, the entire contents of which are hereby incorporated by reference.

What is claimed is:

1. A heating system comprising:
a semiconductor device; and
a transmission/reception device;
the semiconductor device comprising:
a sheet containing a fibrous body,
a converting circuit over the sheet,
a control circuit over the sheet, the control circuit being electrically connected to the converting circuit,
an insulating layer over the converting circuit and the control circuit,
an antenna over and in contact with the insulating layer, the antenna being electrically connected to the converting circuit,
a heater over and in contact with the insulating layer, the heater being electrically connected to the control circuit,
a temperature sensor circuit over the sheet, the temperature sensor circuit being electrically connected to the control circuit,
a charging circuit over the sheet, and
a flexible lithium ion battery over the sheet, electrically connected to the charging circuit,
wherein the antenna receives a radio wave transmitted from the transmission/reception device,
wherein the converting circuit converts the radio wave into electric power,
wherein the heater is heated with the electric power,
wherein the temperature sensor circuit measures temperature of the heater, and
wherein the transmission/reception device determines whether to heat the heater or not based on the temperature of the heater.

2. A heating system comprising:
a semiconductor device; and
a transmission/reception device;
the semiconductor device comprising:
a sheet containing a fibrous body,
a converting circuit over the sheet,
a control circuit over the sheet, the control circuit being electrically connected to the converting circuit,
an insulating layer over the converting circuit and the control circuit,
an antenna over and in contact with the insulating layer, the antenna being electrically connected to the converting circuit,
a heater over and in contact with the insulating layer, the heater being electrically connected to the control circuit,
a temperature sensor circuit over the sheet, the temperature sensor circuit being electrically connected to the control circuit,
a charging circuit over the sheet, and
a flexible lithium ion battery over the sheet, electrically connected to the charging circuit,
wherein the antenna receives a radio wave transmitted from the transmission/reception device,
wherein the converting circuit converts the radio wave into electric power,
wherein the heater is heated with electric power,
wherein the temperature sensor circuit measures temperature of the heater,
wherein the control circuit transmits temperature data of the heater to the transmission/reception device through the antenna, and
wherein the transmission/reception device determines whether to heat the heater or not based on the temperature of the heater.

3. The heating system according to claim 2,
wherein the transmission/reception device stops transmitting a radio wave to stop heating the heater.

4. The heating system according to claim 1,
wherein a plurality of the sheets is arranged to form part of a supporter, a container, gloves, headphones, a sheet, or a carpet being in contact with part of a surface of a living body.

5. The heating system according to claim 2,
wherein a plurality of the sheets is arranged to form part of a supporter, a container, gloves, headphones, a sheet, or a carpet being in contact with part of a surface of a living body.

6. The heating system according to claim 1,
wherein the semiconductor device further comprises a peltier device over the sheet.

7. The heating system according to claim 2,
wherein the semiconductor device further comprises a peltier device over the sheet.

8. The heating system according to claim 1,
wherein a thickness of the sheet is 200 to 500 μm.

9. The heating system according to claim 2,
wherein a thickness of the sheet is 200 to 500 μm.

10. The heating system according to claim 1,
wherein the control circuit comprises a transistor, and
wherein the transistor comprises indium, gallium, zinc, and oxygen.

11. The heating system according to claim 2,
wherein the control circuit comprises a transistor, and
wherein the transistor comprises indium, gallium, zinc, and oxygen.

12. The heating system according to claim 1,
wherein the semiconductor device further comprises a protective layer over the heater.

13. The heating system according to claim 2,
wherein the semiconductor device further comprises a protective layer over the heater.

14. The heating system according to claim 1,
wherein the sheet comprises glass fiber or carbon fiber.

15. The heating system according to claim 2,
wherein the sheet comprises glass fiber or carbon fiber.

* * * * *